US007797907B2

(12) United States Patent
Timmerman et al.

(10) Patent No.: US 7,797,907 B2
(45) Date of Patent: Sep. 21, 2010

(54) LATERAL FORCE RESISTING SYSTEM

(76) Inventors: Timothy L. Timmerman, 9845 Santa Fe Ave. East, Hesperia, CA (US) 92340-2563; Timothy L. Timmerman, II, 9845 Santa Fe Ave. East, Hesperia, CA (US) 92340-2563

( * ) Notice: Subject to any disclaimer, the term of this patent is extended or adjusted under 35 U.S.C. 154(b) by 925 days.

(21) Appl. No.: 11/224,742

(22) Filed: Sep. 9, 2005

(65) Prior Publication Data

US 2006/0059811 A1 Mar. 23, 2006

Related U.S. Application Data

(63) Continuation-in-part of application No. 09/884,709, filed on Jun. 19, 2001, now Pat. No. 7,251,920, which is a continuation-in-part of application No. 09/697,030, filed on Oct. 25, 2000, now abandoned, which is a continuation of application No. 09/060,930, filed on Apr. 14, 1998, now Pat. No. 6,158,184.

(60) Provisional application No. 60/043,835, filed on Apr. 14, 1997.

(51) Int. Cl.

| | |
|---|---|
| ***E04H 9/00*** | (2006.01) |
| ***E04B 5/00*** | (2006.01) |
| ***E04C 2/32*** | (2006.01) |
| ***E04C 2/38*** | (2006.01) |

(52) U.S. Cl. ..... 52/800.12; 52/1; 52/800.18; 52/783.11; 52/274

(58) Field of Classification Search ..... 52/800.12, 52/800.18, 783.11, 789.1, 790.1, 792.1, 792.11, 52/274, 481.1, 293, 1, 167.1
See application file for complete search history.

(56) References Cited

U.S. PATENT DOCUMENTS 3,627,608 A * 12/1971 Steiner et al. ..... 156/211

(Continued)

FOREIGN PATENT DOCUMENTS

JP 03257235 A * 11/1991

*Primary Examiner*—Richard E Chilcot, Jr.
*Assistant Examiner*—Elizabeth A Plummer
(74) *Attorney, Agent, or Firm*—Paul J. Backofen, Esq.; Crockett & Crockett, PC

(57) ABSTRACT

A lateral force resisting system according to the present disclosure includes a metal lateral force resisting panel and holdowns. A foundation bolt placement template may be used to locate and support the foundation bolts during fabrication of the foundation and to further secure the frame foundation interface. The metal lateral force resisting panel may be formed from a single piece of material and may include a plurality of ductility apertures forming lateral force resisting elements to enable the panel to flex without catastrophic failure. In a hybrid configuration, a wooden structural frame may be combined with the metal structural panel. The structural panel may be subdivided into multiple panes using ductility apertures to tailor the response of the panel to the lateral force load. The holdowns secure the rigid structural panel to the foundation bolts and may be either a folded strap and pin configuration or self-tightening.

8 Claims, 19 Drawing Sheets

U.S. PATENT DOCUMENTS 4,192,118 A * 3/1980 Gilb ..... 52/714
4,612,739 A * 9/1986 Wilson ..... 52/1
4,736,554 A * 4/1988 Tyler ..... 52/105
5,706,626 A * 1/1998 Mueller ..... 52/800.12
5,765,331 A * 6/1998 Chang ..... 52/348
6,264,141 B1 * 7/2001 Shim et al. ..... 244/118.5
6,298,612 B1 * 10/2001 Adams ..... 52/167.3
6,367,203 B1 * 4/2002 Graham et al. ..... 52/1
6,607,003 B1 * 8/2003 Wilson ..... 137/68.23
7,251,920 B2 * 8/2007 Timmerman et al. ..... 52/800.13
2001/0004815 A1 * 6/2001 LePoire ..... 52/204.2
2007/0122590 A1 * 5/2007 Lalvani ..... 428/136

* cited by examiner

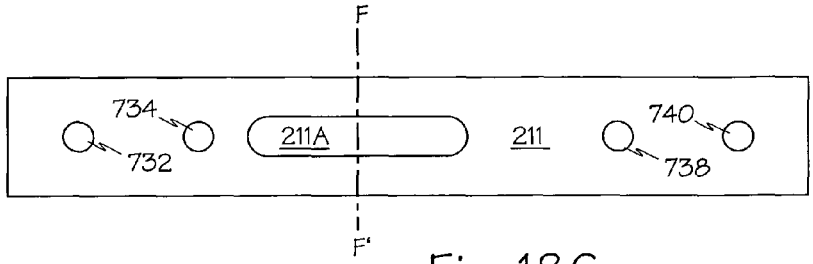
Fig. 18C
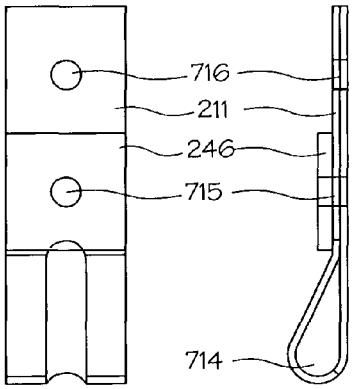
Fig. 18A
Fig. 18B
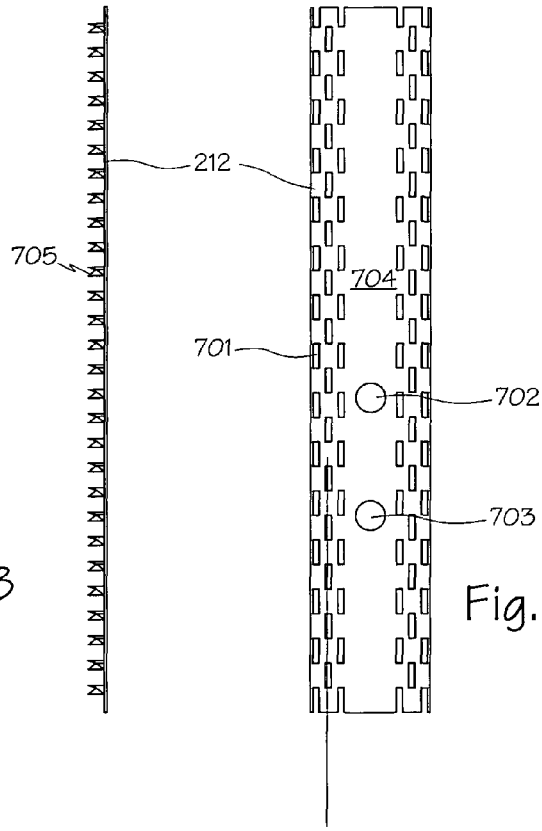
Fig. 17B
Fig. 17A

LATERAL FORCE RESISTING SYSTEM

RELATED APPLICATIONS

This application is a continuation-in-part of U.S. patent application Ser. No. 09/884,709 filed Jun. 19, 2001 now U.S. Pat. No. 7,251,920, which is a continuation-in-part of U.S. patent application Ser. No. 09/067,030 filed Oct. 25, 2000 now abandoned, which is a continuation of U.S. patent application Ser. No. 09/060,930 filed Apr. 14, 1998, now U.S. Pat. No. 6,158,184, which claims the priority of U.S. provisional patent application Ser. No. 60/043,835 filed Apr. 14, 1997.

BACKGROUND

1. Field of the Inventions

The inventions relate generally to the field of building construction and in particular to structural framing elements for building construction.

2. Description of Related Art

Buildings are subjected to many forces. Among the most significant are gravity, wind, and seismic forces. Gravity is a vertically acting force, wind and seismic forces are primarily lateral (horizontal). Many buildings use shearwall diaphragms or panels to resist lateral loads. A shearwall panel is formed by the application of one or more types of sheathing such as, plywood, fiberboard, particleboard, and or drywall (gypsum board), to the inside or outside or both sides of a wall frame. The sheathing is fastened to the wall frame at many points creating a shearwall diaphragm or panel. Many suitable fasteners are available and nails are commonly used and will be referred to hereafter. The sheathed shearwall panel is used to conduct the lateral force acting on the frame of the building to the foundation.

Buildings require a strong base for support. Most buildings have a concrete base that is generally referred to as the foundation. A concrete pad whose top forms a continuous plane from edge to edge is called a slab. With a slab the concrete forms the floor of the building. The deepest concrete support that follows the perimeter of the building is called the footing. In a building without a concrete floor, the floor may be supported by short concrete walls called stem walls that are supported by the footing. Some grading considerations or design requirements necessitate a hybrid of a slab and a stem wall. This results in the use of short concrete walls extending from a few inches to a few feet above the level of the concrete floor. Foundation will be used hereafter in place of stem wall, footing, and slab.

The site where the building is to be erected is first graded (leveled). Wooden boards are nailed together to create a 'form' or mold for the foundation (slab, footing, stem wall). The forms mark the edges of the foundation. Next, wet concrete is poured into the form and the surface is smoothed and the concrete is allowed to harden. As the concrete hardens, bolts are partially imbedded in the top of the foundation with the threaded end of each bolt protruding out of the foundation. The bolts are embedded wherever a wall will contact the foundation/stem wall to provide a means of securing the wall to the foundation.

The frame of the walls is fabricated next. Each wall frame section is composed of several elements. In North America, the wall frames of most homes and small buildings use wood or metal elements having cross sectional dimensions of 2"×4", 2"×6", or 2"×8". At the base of a wall frame is an element called a mudsill, and wood or metal stud elements are attached on top of, and perpendicular to, the mudsill On top of the studs is a top plate that is secured to each stud. Holes are drilled through the mudsill for the foundation bolts to pass through the mudsill. After the wall frame elements are connected together, the wall frame is put in its finished location with the foundation bolts protruding through the holes drilled in the mudsill. Once adjacent wall frames are in place, they are secured together at the corners and an additional plate (top cap) may be added which overlaps the top plates of adjacent wall frames.

After the building frame is completed, the building is ready to be sheathed. Conventional building construction uses sheathing inside a building (drywall) that forms the wall surface that we all see, and sheathing on the roof that helps keep the building dry. Plywood or other sheathing is also applied to the outside and sometimes the inside walls of every building. The combination element created by many fasteners attached through plywood and or drywall into the supporting wall studs, mudsill and top plates create a sturdy diaphragm known as a sheathed shearwall. Drywall or gypsum sheathing provides insulation and fire resistance and some structural stability. The structural contribution of a drywall panel is limited because of the relatively delicate composition of the drywall. Where higher lateral force resistance is required, builders and designers generally use plywood or particleboard or fiberboard or metal sheathing fastened to the wall frame in addition to the drywall. Plywood is the most common choice and will be discussed hereafter, but other suitable materials may be used. Plywood is available in 4'×8' sheets that vary from ¼" to over 1" in thickness. Plywood is composed of many thin layers of wood glued together under pressure with the grain pattern of adjacent layers perpendicular to each other for strength.

Review of damage following the Northridge earthquake, revealed that many plywood sheathed shearwalls failed under the seismic forces. The nailing of the sheathing in the field during construction leads to many failures. Nails driven through the sheathing miss the frame member they were intended to penetrate creating 'shiners'. Nail heads penetrate the skin of the sheathing during nailing which weakens the sheathing and allows the nails to be pulled through the sheathing under load conditions as well as inducing failures in the integrity of the sheathing. Shearwall fabrication requires regular nail spacing of 3"-12" depending on the design requirements. Current field fabrication techniques are not sufficiently accurate to consistently meet the design specifications. Therefore every shearwall panel may be nailed differently and many may be installed with fewer nails than required to handle the required design load.

The rise in land prices has caused the building of more multiple floor dwellings to raise housing density. Multiple floors significantly increase lateral loads and thus increase the use of field fabricated sheathed shearwalls. In many multiple story buildings the entire outside of the building may be sheathed.

Consequently, many building departments may be limiting sheathed shearwalls to a maximum height/width ratio of 2:1. Where walls are typically eight feet high, the minimum shearwall width would be four feet. This restriction has implications throughout a building. At the front of a garage narrow shearwalls, two to three foot wide, are common. Narrow sheathed shearwalls are also common adjacent to window and door openings.

The interface between the shearwall and the foundation may also be area of weakness. The conventional practice of locating holdowns within the framework of a sheathed shearwall weakens the sheer wall and the frame-foundation interface. Bolts imbedded in the concrete of the foundation provide attachment points for the walls and shear panels. These bolts are intended to pass through the mudsill of the sheathed shearwall to prevent lateral movement between the sheathed shearwall and the foundation. The foundation bolts also transfer the lateral load from the top of the sheathed shearwall to the foundation. Quite often the bolts that are supposed to secure the walls and shear panels are placed several inches away from where they are required for optimum load transfer and ease of wall construction due to inaccurate measuring and carelessness during field installation of the bolts. The resulting misalignment forces some of the framing members to be trimmed to fit, or in some cases, the intended foundation bolt must be cut off and an epoxy bolt or a "red head" must be used. The resulting attachment of the wall to the foundation is a potential point of failure.

Another common fabrication error is oversize holes in the mudsill. The mudsill is the base member of a wall frame that is in direct contact with the foundation. Many different causes result in holes in the mudsill which don't line up with the bolts placed in the foundation or in the stem wall. This requires extra holes, or oversize or elongated holes be created in the mudsill which may weaken the frame-foundation interface.

The attachment hardware that may be used to connect a shearwall to the foundation may be another point of weakness. If a field-fabricated shearwall were ever built in exact compliance with the design, the attachment hardware would likely fail before the shearwall. In most cases the attachment hardware is fabricated by folding steel strips with a few tack welds. In practice the folds provide the necessary flex in the attachment hardware to induce failure. In other cases, the method of attaching the attachment hardware to the studs induces cracking of the studs.

Another problem exposed by the Northridge earthquake is the illusion that stiffer is better where lateral force resistance is desired. For example, in one apartment building the lateral force resistance was provided by steel I-beams secured in the foundation. The result in an earthquake was that the very stiff I-beams experienced catastrophic failure. High-rise building engineers and architects learned this lesson, buildings should flex with the ground forces and resist catastrophic failure and remain standing.

Conventional manufacturers of shear panels continue to add elements and stiffness to their products to try and eliminate ductility or flex in their products. As a result, most conventional manufactured shear panels experience catastrophic failure when developing their maximum shear resistance.

What is needed is a manufactured shear resistance system that may include elements intended to bend, stretch, or otherwise fail to permit the system to resist the lateral loading without catastrophic failure.

SUMMARY

Lateral force resistance of a building frame may be provided using manufactured steel or hybrid lateral force resisting systems, including one or more metal lateral force resisting panels and may include wood or metal posts and holdowns. In addition, a foundation bolt placement template may also be used. The lateral force resisting system may be used in wood frame as well as metal frame buildings. The holdowns should be located outside the perimeter of the lateral force resisting system to minimize the overturning forces.

In another aspect of the present disclosure, a lateral force resisting system combines a wooden frame with a steel panel into a hybrid resistance system. The steel panel is folded to surround at lease three sides of the side posts enabling the side posts to be smaller than in previous configurations. In this configuration, the holdowns are secured through the steel panel and the side posts with the holdowns outside the perimeter of the lateral force resisting panel. The steel panel includes a plurality of ductility elements to enable the panel to flex under load and resist catastrophic failures.

In another aspect of the present disclosure, a tailored ductility lateral force resisting system according to the present invention may incorporate a plurality of lateral load absorbing or damping elements, or ductility elements between openings in the lateral force resisting panel to provide a tailored ductile response to lateral loading and resist catastrophic failure.

A lateral force resisting system according to the present disclosure includes a metal lateral force resisting panel and holdowns. A foundation bolt placement template may be used to locate and support the foundation bolts during fabrication of the foundation and to further secure the frame foundation interface. The metal lateral force resisting panel may be formed from a single piece of material and may include a plurality of ductility apertures forming lateral force resisting elements to enable the panel to flex without catastrophic failure. In a hybrid configuration, a wooden structural frame may be combined with the metal structural panel. The structural panel may be subdivided into multiple panes using ductility apertures to tailor the response of the panel to the lateral force load. The holdowns secure the rigid structural panel to the foundation bolts and may be either a folded strap and pin configuration or self-tightening.

A lateral force resisting apparatus according to the present disclosure includes a unitary lateral resisting panel having at least one pane between each pair of at least two post elements, and one or more arrays of lateral resisting elements formed by a plurality of lateral resisting apertures in the pane.

An alternate lateral force resisting apparatus according to the present disclosure includes a unitary lateral resisting panel having at least one pane between each pair of at least two post elements, one or more arrays of lateral resisting elements formed by a plurality of lateral resisting apertures in the pane, a base sleeve secured within each of the at least two post elements, and attachment means for securing each base sleeve to a foundation bolt.

These and other features and advantages of this system will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIGS. 17A-17B are two views of a reinforcing plate according to the present disclosure.

FIGS. 18A-18C are views of a holdown strap according to the present disclosure.

DETAILED DESCRIPTION OF THE INVENTIONS

Figures 1A, 1B:
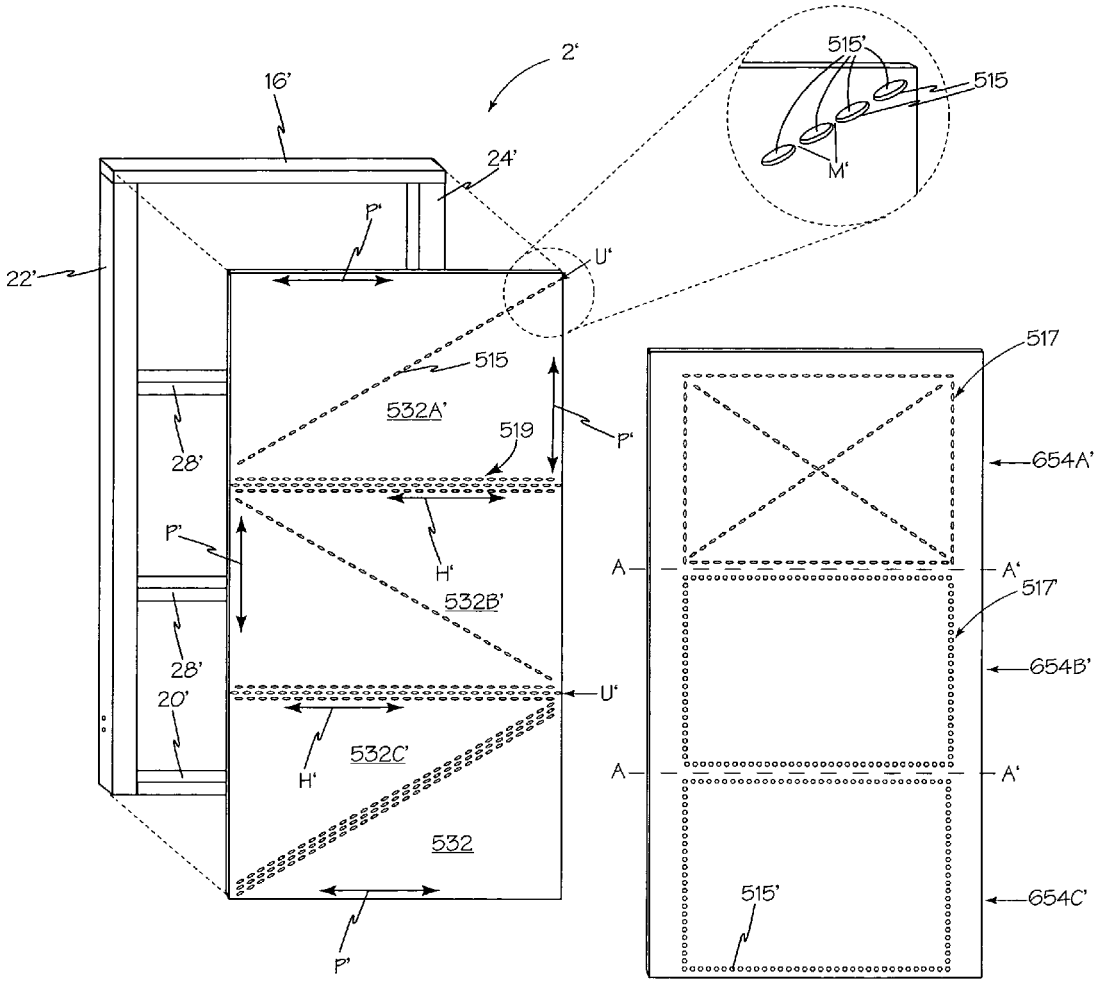
FIG. 1A is an exploded perspective view of a rigid structural frame according to the present disclosure.
FIG. 1B is a front view of an alternate configuration of a lateral load-damping element according to the present disclosure.

Referring now to FIGS. 1A and 1B, rigid structural panel 2' may include elements made of steel or other similar material instead of wood. Rigid structural panel 2' may include first side member 22', second side member 24', top member 16', sill plate 20' and one or more horizontal spacing members 28' which may all be C-channel elements. Other element geometries such as square or rectangular may be used. Panel 532' may function as a lateral force resisting element in the present invention. Panel 532' may be permanently or removable secured to rigid structural panel 2' along perimeter P' and also to horizontal spacing members 28' along H'. Panel 532' may also be subdivided into sub panels 532A', 532B' and 532C' by attachment along H' and or load strips 519. Tailored ductility of rigid structural panel 2' may be achieved using one or more load points 515 cut or otherwise opened through panel 532'. Load points such as load point 515 may have many suitable shapes such as but not limited to squares, rectangles, ovals and circles 515' and may be arranged into patterns such as pattern 517 or 517', or grouped into parallel units U'. Material M' surrounding load points 515 may serve to absorb lateral loading and deform without causing out of plane deflection of rigid structural panel 2'. Load point 515 may be formed by removing material 515' or by cutting and bending the material of panel 532' to form vent style openings.

Figure 2A:
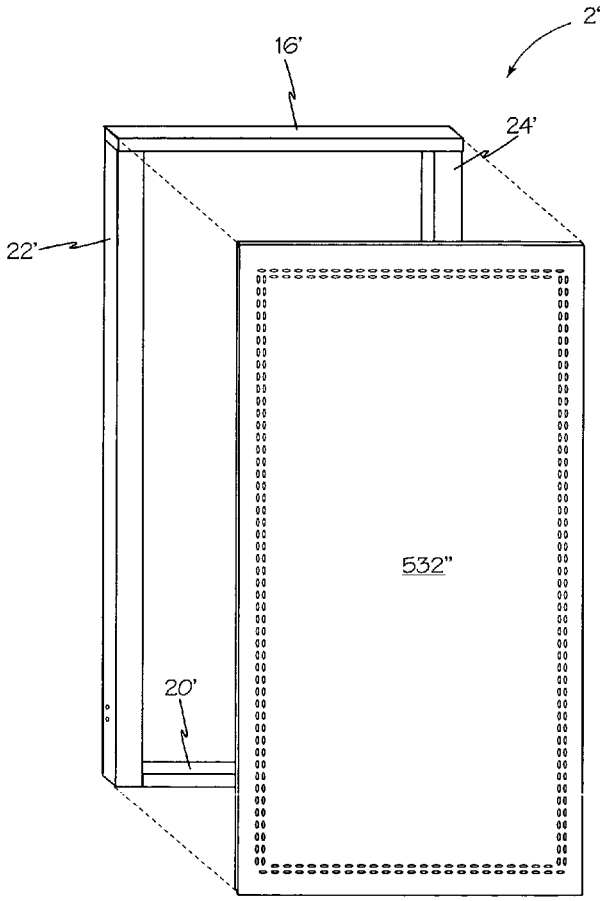
FIG. 2A is an exploded perspective view of alternate configuration of a rigid structural frame according to the present disclosure.
Figure 2B:
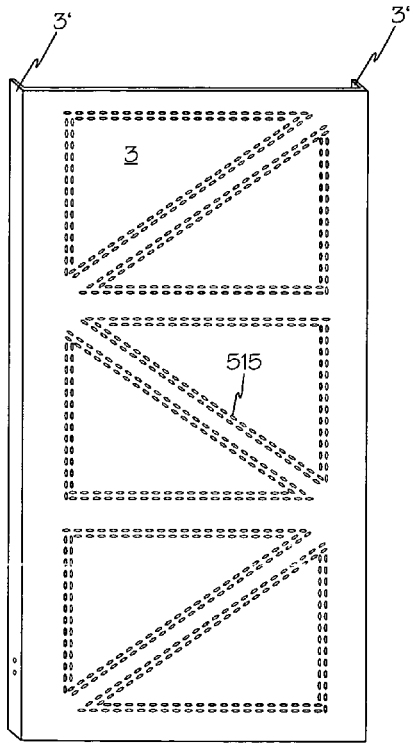
FIG. 2B is a front view of an alternate configuration of a lateral load-damping element according to the present disclosure.

Referring now to FIGS. 2A and 2B, in an alternate embodiment of the present invention, rigid structural panel 2' includes only first side member 22', second side member 24', top member 16', sill plate 20' and one or more horizontal spacing members 28'. Panel 532" may be a single element as shown in FIG. 2A, or panel 3 may be subdivided using load points 515 as shown in FIG. 2B.

Figure 3:
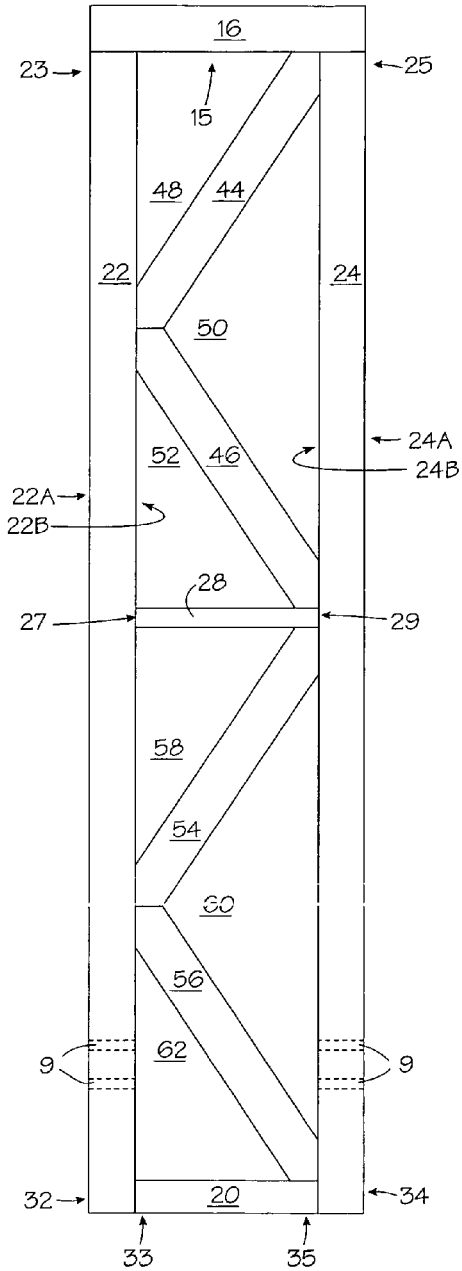
FIG. 3 is a front view of an alternate configuration of a rigid structural frame according to the present disclosure.

Referring now to FIG. 3, a front view of one aspect of the present invention is shown. Rigid structural panel 2 is configured as a vertical truss for applications requiring a 1-3½ foot wide lateral force resistance panel. Sill plate 20 forms the base of rigid structural panel 2. Sill plate 20 is perpendicular to first side member 22. First side member 22 is parallel to second side member 24. First end 33 of sill plate 20 abuts bottom end 32 of first side member 22. Second end 35 of sill plate 20 abuts bottom end 34 of second side member 24. Top member 16 is perpendicular to first side member 22 and second side member 24. Bottom side 15 of top member 16 abuts top end 23 of first side member 22, and bottom side 15 similarly abuts top end 25 of second side member 24. Horizontal spacing member 28 is approximately equidistant between top member 16 and sill plate 20. First end 27 and second end 29 of horizontal spacing member 28 abut first side member 22 and second side member 24 respectively. Within the rectangle formed by top member 16, first side member 22, second side member 24 and horizontal spacing member 28, are a plurality of web members that form structural support triangles. First web member 44 and second web member 46 form structural support triangles 48, 50, and 52. Within the rectangle formed by sill plate 20, first side member 22, and horizontal spacing member 28, and second side member 24 are web member 54 and web member 56, which form triangles such as structural support triangles 58, 60, and 62.

Figure 4:
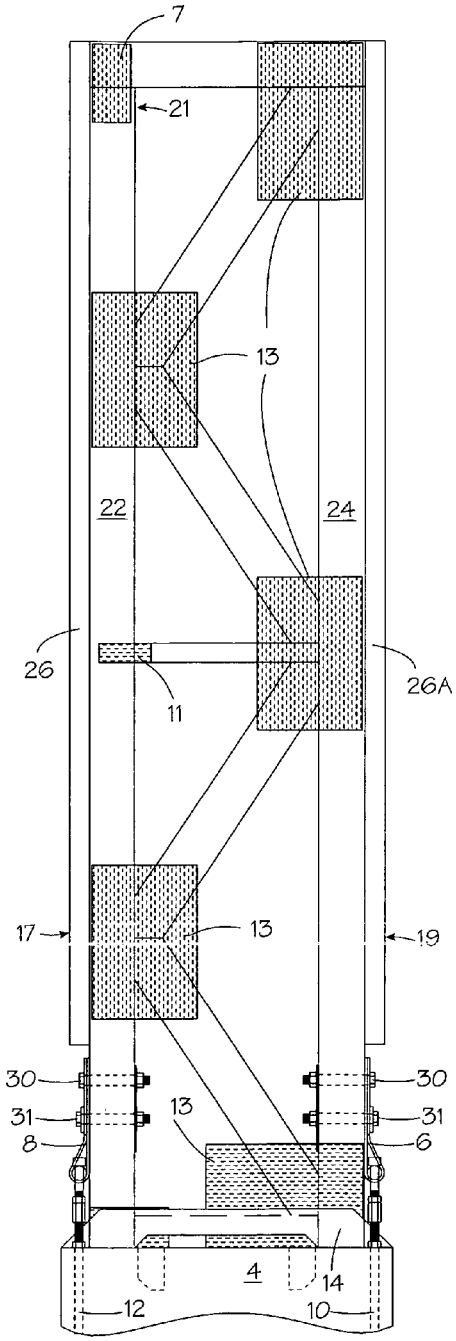
FIG. 4 is a front view of the rigid structural frame of FIG. 4 configured for use according to the present disclosure.

Referring now to FIG. 4, a front view of a currently preferred embodiment of the present invention, showing rigid structural panel 2, secured to foundation 4, by foundation bolt placement template 14 and holdowns 6 and 8 engaged to foundation bolts 10 and 12 respectively. Furring boards 26 and 26A are attached to first side member 22 and second side member 24 respectively. As shown in FIG. 4, furring boards 26 and 26A enable stud 115 and trimmer 114 to be solidly attached at side 17 and side 19 respectively.

Rigid structural panel 2 may include horizontal spacing member 28, however a suitable rigid structural panel may not include a horizontal spacing member. Horizontal spacing member 28 simplifies the fabrication of the rigid structural panel by bracing the vertical side members during fabrication. The horizontal dimensions of rigid structural panels fabricated with a horizontal spacing member(s) 28 are more consistent because a bow in first side member 22 or in second side member 24 may be removed during fabrication.

In another aspect of the present invention, near bottom end 32 of first side member 22 and bottom end 34 of second side member 24 are transverse holes 9, parallel to sill plate 20. Holes 9 accept bolts such as bolt 30 for attaching holdowns such as holdown 6 and holdown 8 as shown in FIG. 4.

Figure 5:
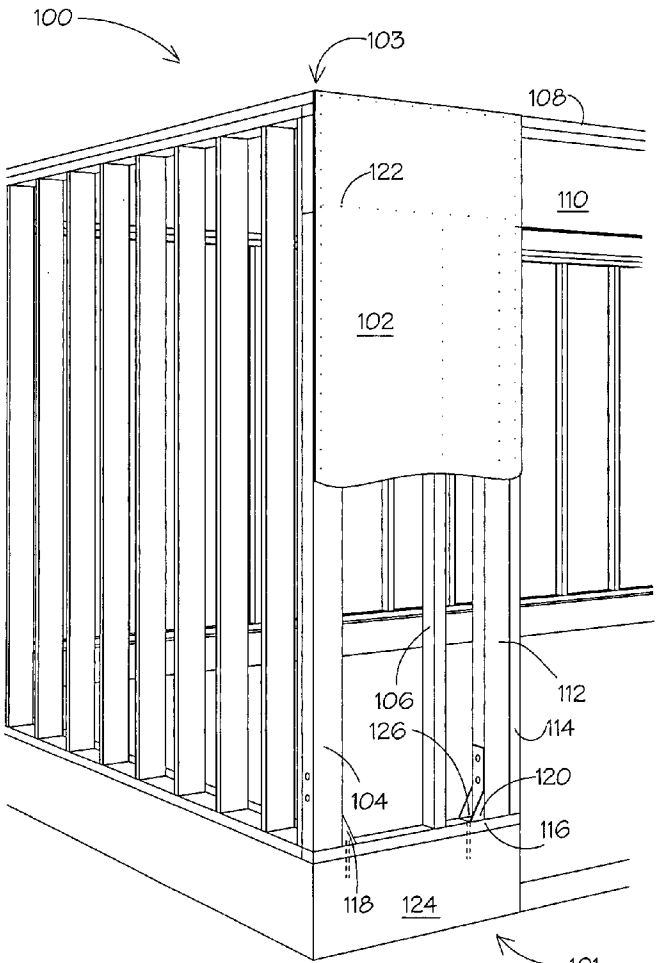
Fig. 5 (Prior Art)
FIG. 5 is a perspective view of the prior art wood framing techniques showing the elements of a building frame and a section of a sheathed shearwall.

Referring now to FIG. 5, building frame 100 is an example of conventional building framing. Fastening sheathing 102 to corner post 104, stud 106, top cap 108, header 110, post 112, trimmer 114 and mudsill 116 forms Shearwall 101. Sheathing 102 may be fastened to frame members 104-116 in any conventional manner such as nails or screws. A plurality of fasteners 122 attach sheathing 102 to frame members 104-116, at regular intervals along frame members 104-116 and along periphery 103 of sheathing 102. Holdowns 118 and 120 are secured to corner post 104 and post 112, respectively, within shearwall 101. Holdown 118 and 120 are secured to foundation 124 by a bolt, such as bolt 126, shown penetrating holdown 120 and mudsill 116.

Figure 6:
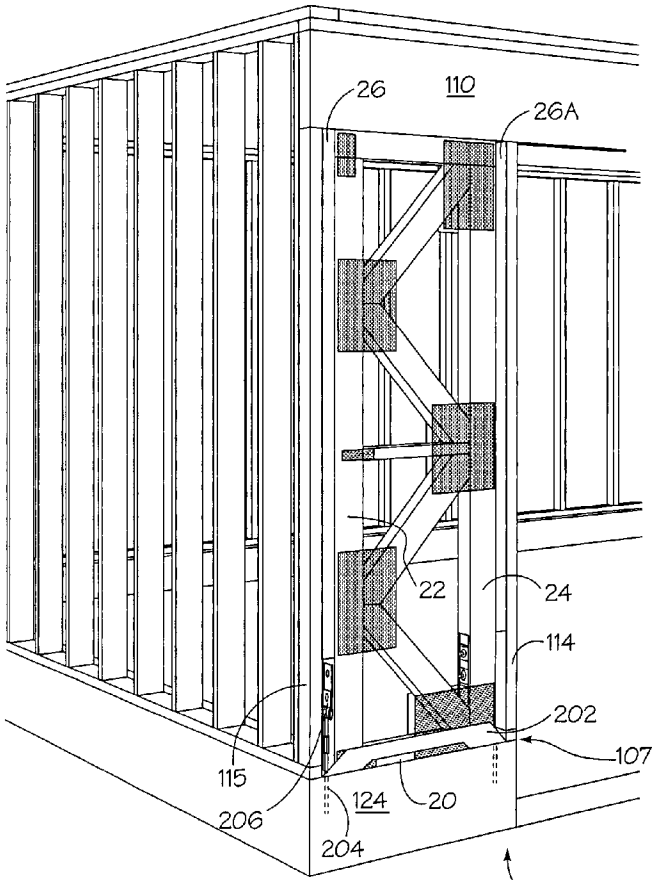
FIG. 6 is a perspective view with the rigid structural frame of FIG. 4 integrated in a building frame as a replacement for a section of conventional sheathed shearwall.

Referring now to FIG. 6, the present invention is shown as a replacement for shearwall 101. In this embodiment, rigid structural panel 200 is configured as a vertical truss and provides vertical support for header 110. Foundation bolt placement template 202 locates and supports foundation bolts such as bolt 204 during fabrication of foundation 124. Foundation bolt placement template 202 also attaches to sill plate 20, bottom end 32 of first side member 22, and bottom end 34 of second side member 24 to further secure frame-foundation interface 107. Two holdowns such as holdown 206 are attached to the outside of panel 200 to further secure panel 200 to foundation 124.

Figure 7:
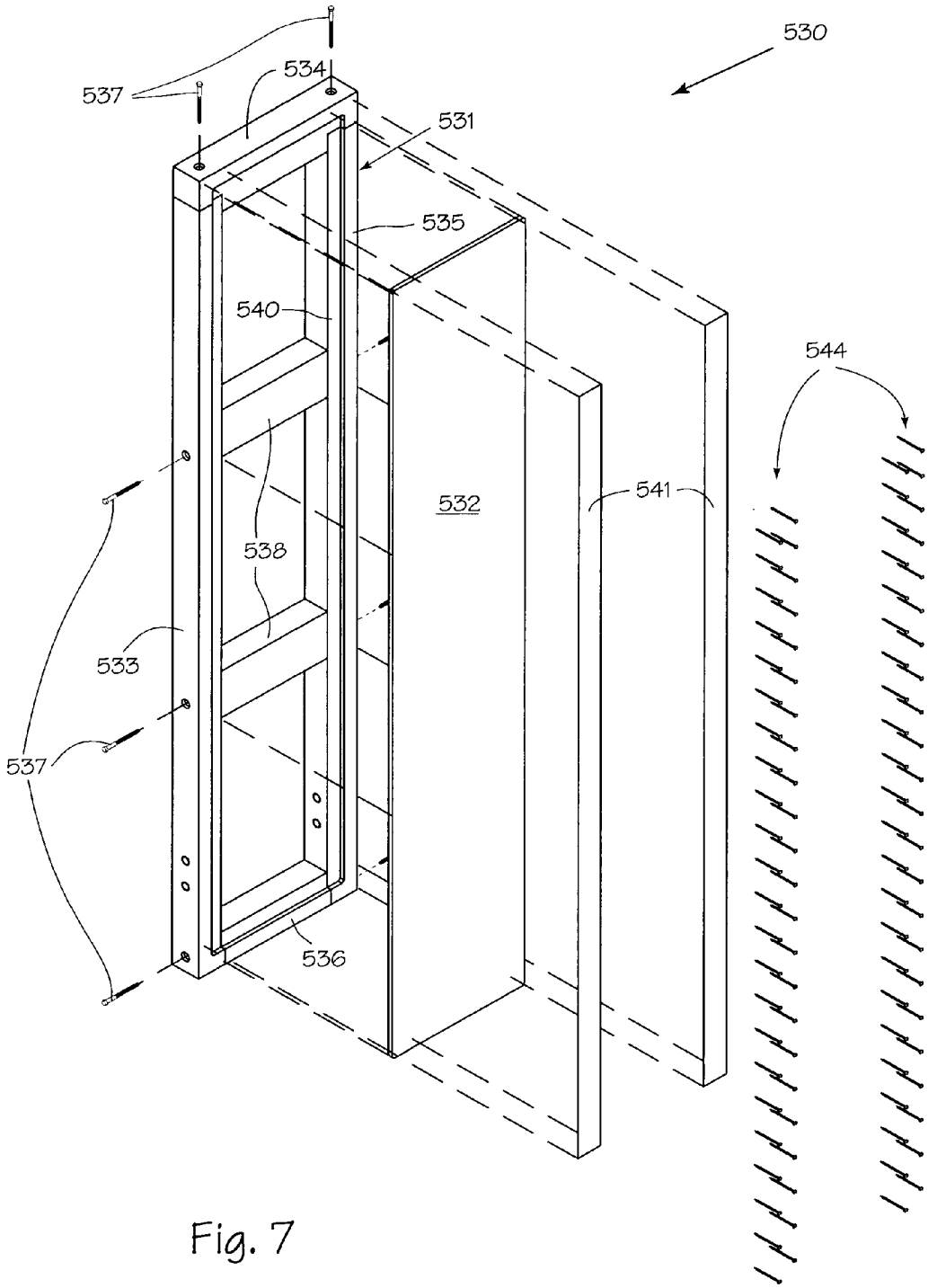
FIG. 7 is a perspective view of another configuration of a rigid structural panel according to the present disclosure.

Referring now to FIG. 7, in a currently preferred embodiment of the present invention rigid structural panel 530 is configured as a generally rectangular frame 531 covered on side 539 by a panel 532. In this configuration first vertical side member 533 and second vertical side member 535 are connected by top end 534 and bottom end 536. One or more interior dividers 538 may divide the interior opening. The elements of rectangular frame 531 are connected together by any conventional connector, here bolts 537 are used. Panel 532 is attached to side 539 using any conventional fasteners. In a currently preferred embodiment of the present invention panel 532 is an oriented strand board (OSB) panel and is inset into dado 540 in rectangular frame 531. Plates 541 are fastened over joints 542 and 543 formed between panel 532 and frame 531. Any conventional fastener 544 may be used to attach plates 541, here fasteners 544 are #10 common galvanized nails are every 4". In a currently preferred embodiment of the present invention plates 541 are 20 gauge galvanized steel however, other suitable materials may be used.

Figure 8:
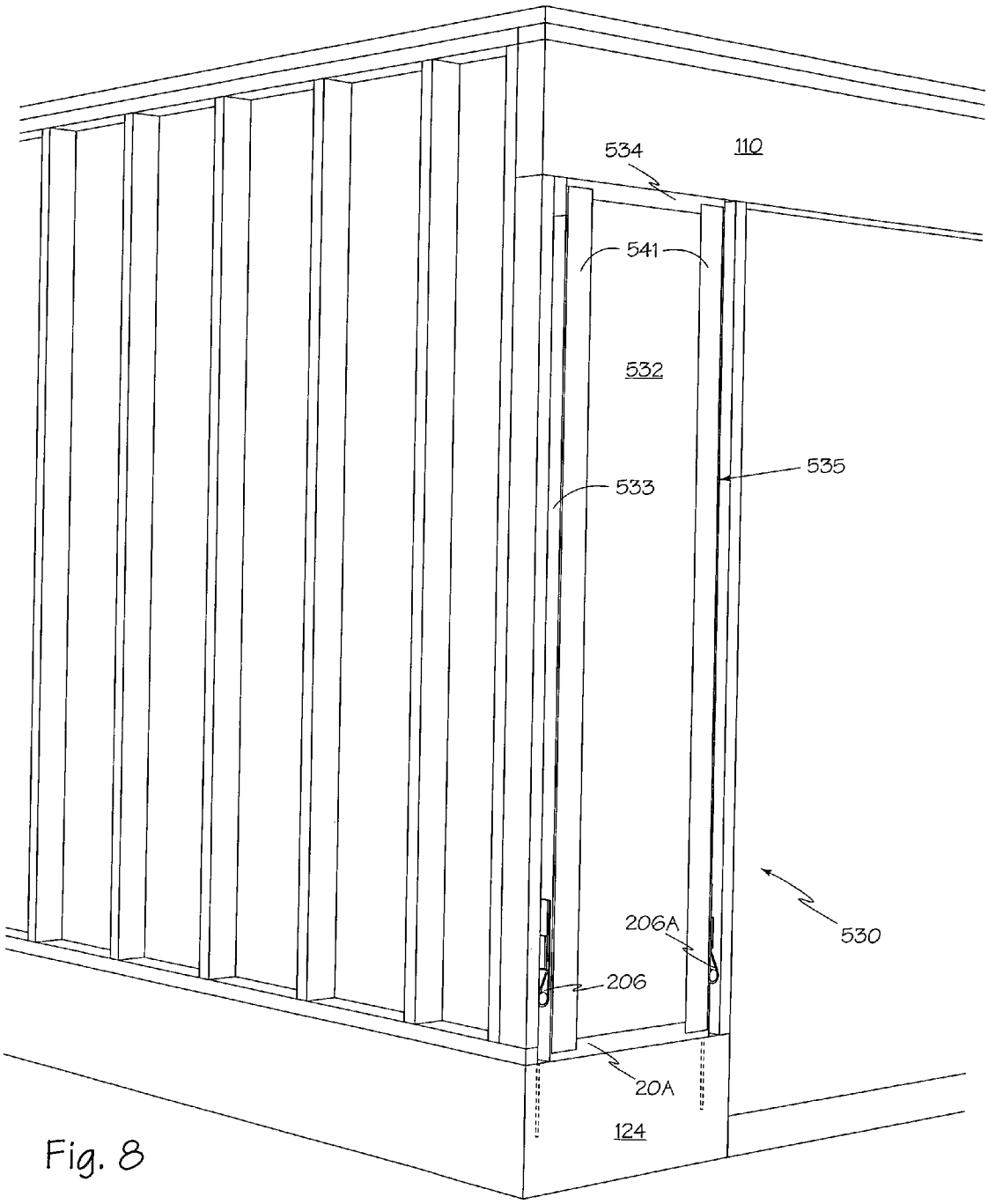
FIG. 8 is a perspective view of a building frame with the shear panel of FIG. 7 as a replacement for a conventional sheathed shearwall.

Referring now to FIG. 8, the present invention is shown as a replacement for shearwall 101. In this embodiment, rigid structural panel 530 provides vertical support for header 110. Holdowns 206 and 206A are attached to first vertical side member 533 and second vertical side member 535 respectively, to secure rigid structural panel 530 to foundation 124. Rigid structural panel 530 may be secured to foundation 124 without the use of a foundation bolt placement template.

Figure 9:
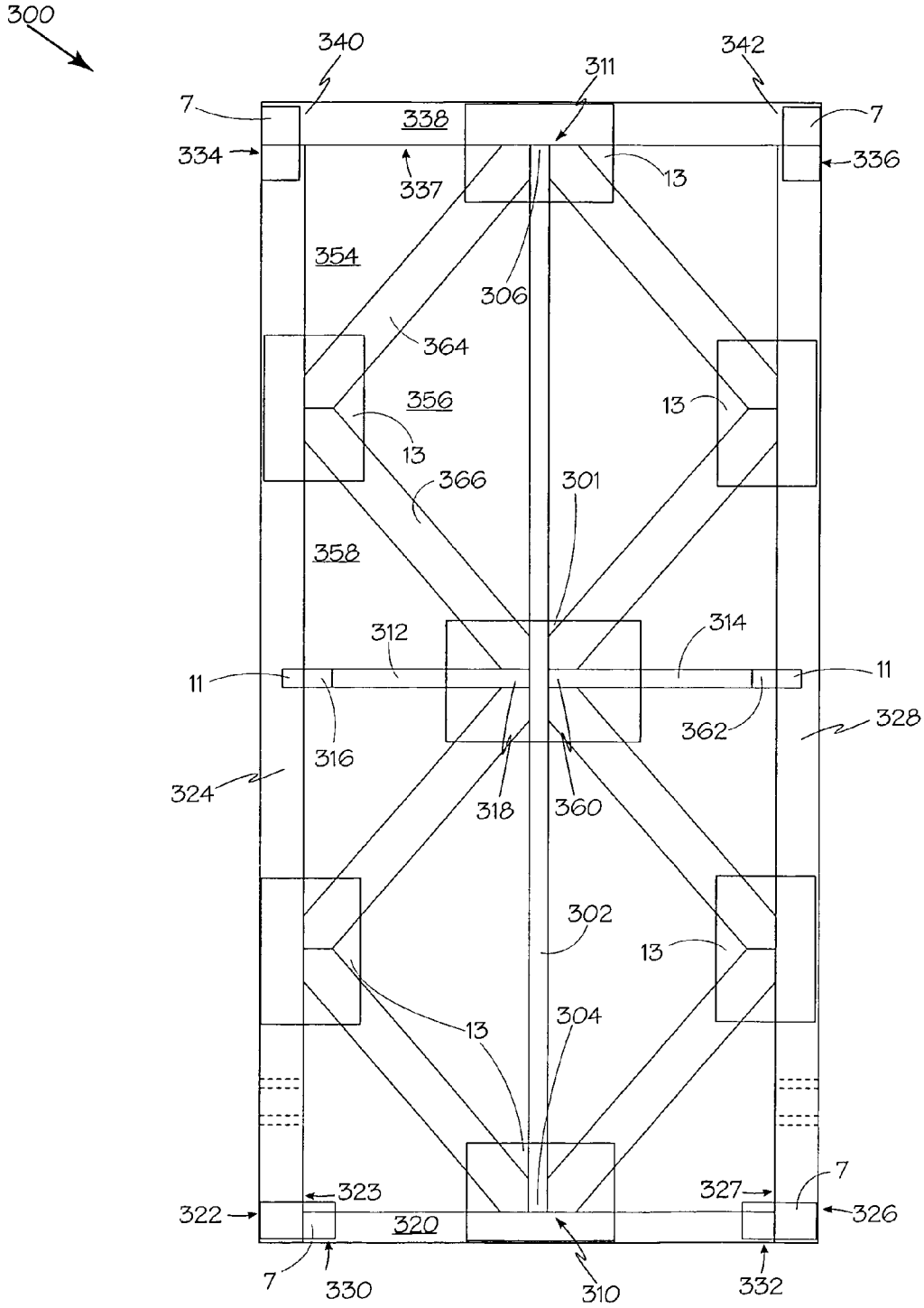
FIG. 9 is a front view of another alternate configuration of a rigid structural panel.

Referring now to FIG. 9, another aspect of the present invention is shown in which rigid structural panel 300 is configured for applications requiring a 3½-6½ foot wide lateral force resistance panel. Rigid structural panel 300 includes sill plate 320, perpendicular to first side member 324, first end 330 of sill plate 320 abuts side 323 of bottom end 322 of first side member 324. Sill plate 320 is also perpendicular to second side member 328, second end 332 of sill plate 320, abuts side 327 of bottom end 326 of second side member 328. First side member 324 is parallel to second side member 328. Vertical support 302 is perpendicular to sill plate 320, bottom end 304 of vertical support 302 abuts top center 310 of sill plate 320. Top member 338 is perpendicular to first side member 324, bottom side 337 of first end 340 of top member 338, abuts top end 334 of first member 324. Top member 338 is perpendicular to vertical support 302, bottom point 311 of top member 338 abuts top end 306 of vertical support 302. Top member 338 is also perpendicular to second side member 328, bottom side 337 of second end 342 abuts top end 336 of second side member 328. Horizontal spacing member 312 is about equidistant between sill plate 320 and top member 338. First end 316 of horizontal spacing member 312 abuts first side member 324 and second end 318 of horizontal spacing member 312 abuts vertical support 302. Horizontal spacing member 314 is about equidistant between sill plates 320 and 338. First end 360 of horizontal spacing member 314 abuts vertical support 302 and second end 362 of horizontal spacing member 314 abuts second side member 328. A plurality of rectangles are formed by the arrangement of first side member 324, second side member top member 338, second side member 328, sill plate 320, vertical support 302 and horizontal spacing members 312 and 314. Within each rectangle thus formed, are a plurality of web members forming structural triangles. For example, within the rectangle formed by first side member 324, top member 338, vertical support 302 and spacing member 312 are web members 364 and 366 that form triangles such as structural triangles 354, 356 and 358. The angular orientation of adjacent web members, and the orientation of web members in adjacent rectangles alternates as shown.

In an alternate embodiment, vertical support 302 may be a 4"×4", member. Rectangle 301A formed by first side member 324, top member 338, vertical support 302 and sill plate 320 is covered by a panel 532. Adjacent rectangle 301B formed by second side member 328, top member 338, vertical support 302 and sill plate 320 is covered by a panel 532.

Rigid structural panel 300 may include a plurality of horizontal spacing members such as horizontal spacing members 312 and 314. The addition of horizontal spacing members 312 and 314 simplifies the fabrication of the rigid structural panel by bracing first and second side members 324 and 328 and vertical support 302 during fabrication. The horizontal dimension of a rigid structural panel is more consistent using horizontal spacing members 312 and 314, because a bow in first side member 312, or in second side member 314, or in vertical support 302 may be removed during fabrication. Horizontal spacing members may be included and secured as shown in FIG. 7.

Referring more specifically to FIGS. 1,7, and 8, in another aspect of the present invention, every joint such as joint 21 of rigid structural panel 2, where two or more members join, a truss plate or gang nail plate, such as truss plate 7 is pressed into each face of the joint which is common to all the members of the joint, that is, the front and back of the joint, to secure the joint. A 20 Ga. truss plate such as plates 7 and 11 is used for joints of only two members. A joint of three or four members uses an 18 Ga. truss plate such as plate 13. A joint of five or more members uses a 16 Ga. truss plate such as plate 301 of FIGS. 7 and 8.

Figure 10:
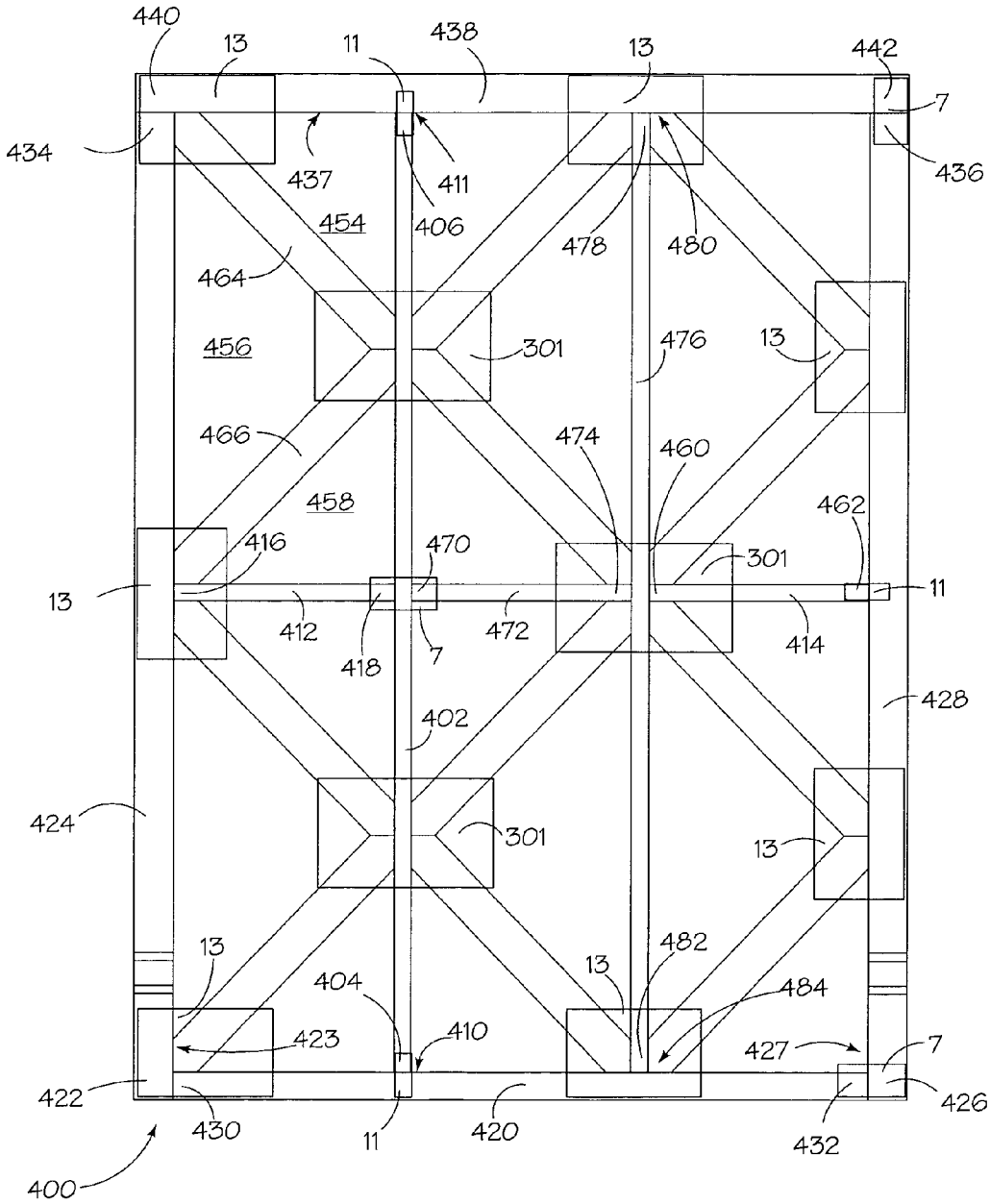
FIG. 10 is a front view of still another alternate configuration of a rigid structural panel.

Referring now to FIG. 10, another aspect of the present invention is shown in which rigid structural panel 400 is configured for applications requiring a 5½-8½ foot wide lateral force resistance panel. Rigid structural panel 400 includes sill plate 420, perpendicular to first side member 424, first end 430 of sill plate 420 abuts side 423 of bottom end 422 of first side member 424. Sill plate 420 is also perpendicular to second side member 428, second end 432 of sill plate 420, abuts side 427 of bottom end 426 of second side member 428. First side member 424 is parallel to second side member 428. Vertical support 402 is perpendicular to sill plate 420, bottom end 404 of first vertical support 402 abuts top point 410 of sill plate 420. Second vertical support 476 is perpendicular to sill plate 420 bottom end 482 of second vertical support 476 abuts top point 484 of sill plate 420. Top member 438 is perpendicular to first side member 424 bottom side 437 of first end 440 of top member 438, abuts top end 434 of first side member 424. Top member 438 is perpendicular to first vertical support 402 bottom point 411 of top member 438 abuts top end 406 of first vertical support 402. Top member 438 is perpendicular to second vertical support 476 bottom point 480 of top member 438 abuts top end 478 of second vertical support 476. Top member 438 is also perpendicular to second side member 428 bottom side 437 of second end 442 abuts top end 436 of second side member 428. Horizontal spacing members 412, 472, and 414 are about equidistant between sill plate 420 and top member 438. First end 416 of horizontal spacing member 412 abuts first side member 424, and second end 418 of horizontal spacing member 412 abuts first vertical support 402. First end 470 of horizontal spacing member 472 abuts first vertical support 402, and second end 474 of horizontal spacing member 472 abuts second vertical support 476. First end 460 of spacing member 414 abuts second vertical support 476, and second end 462 of spacing member 414 abuts second side member 428. A plurality of horizontally adjacent rectangles are formed by the arrangement of first side member 424, second side member top member 438, second side member 428, sill plate 420, first vertical support 402 and horizontal spacing members 412 and 414. Within each rectangle thus formed, a plurality of web members form structural triangles. For example, within the rectangle formed by first side member 424, top member 438, first vertical support 402 and spacing member 412 are web members 464 and 466 that form triangles such as structural triangles 454, 456 and 458.

In an alternate embodiment, vertical supports 402 and 476 may be 4"×4" members. Rectangle 401A formed by first side member 424, top member 438, vertical support 402 and sill plate 420 is covered by a panel 532. Horizontally adjacent rectangle 401B is formed by vertical support 476, top member 338, vertical support 402 and sill plate 420 is covered by a panel 532. Rectangle 401C formed by second side member 428, top member 438, vertical support 476 and sill plate 420 is covered by a panel 532.

Rigid structural panel 400 may include a plurality of horizontal spacing members such as horizontal spacing members 412, 414 and 472. The addition of horizontal spacing members 412, 414 and 472 simplifies the fabrication of the rigid structural panel by bracing first and second side members 424 and 428 and vertical supports 402 and 476 during fabrication. The horizontal dimension of a rigid structural panel is more consistent using horizontal spacing members 412, 414 and 472, because a bow in first side member 412, or in second side member 414, or in vertical support 402 or 476 may be removed during fabrication. Horizontal spacing members may be included and secured as shown in FIG. 7.

Figure 12:
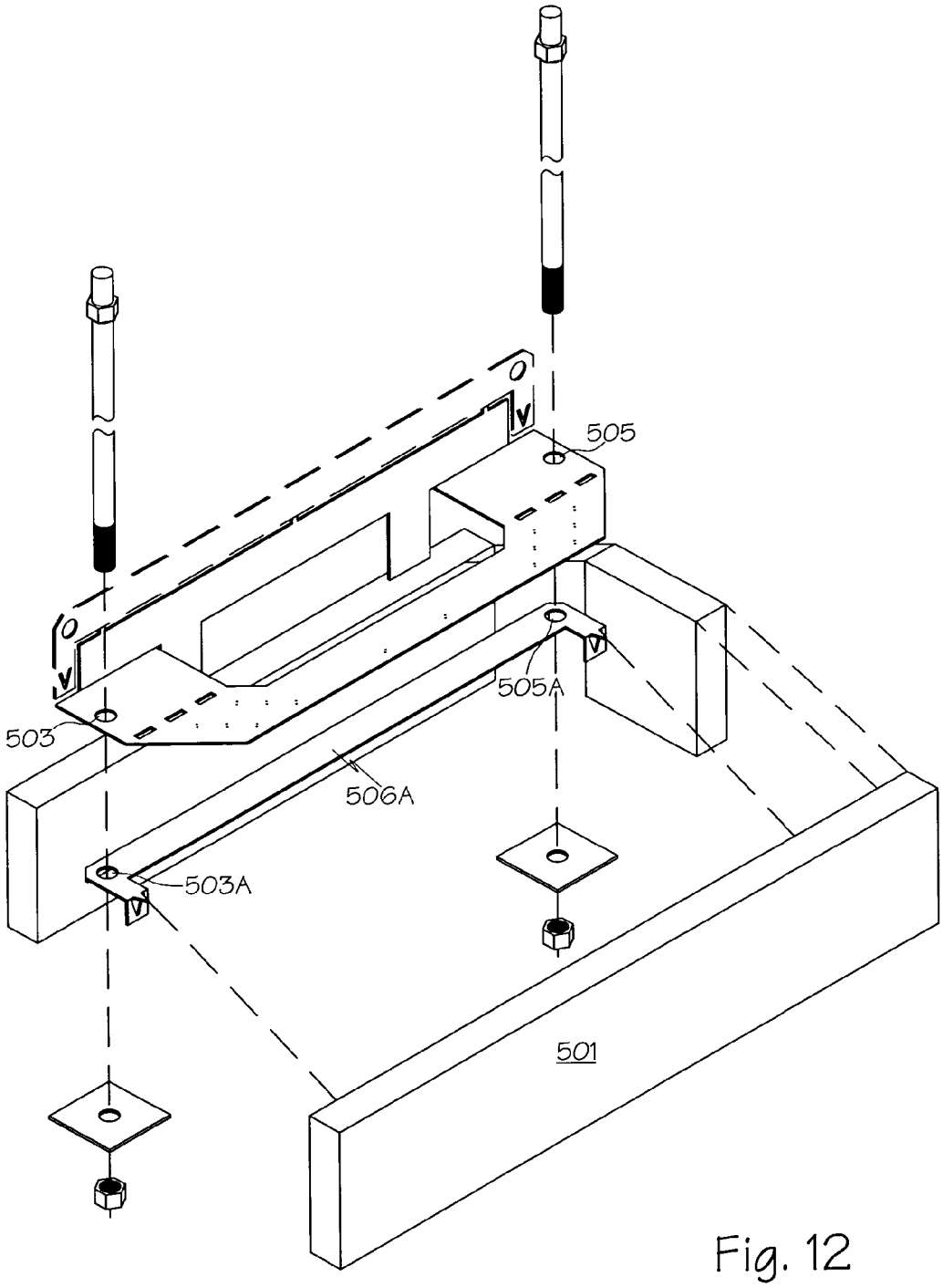
FIG. 12 is an exploded perspective view of the foundation bolt placement template of FIGS. 11(*a*)-(*c*) showing the installation of the bolts.
Figure 13:
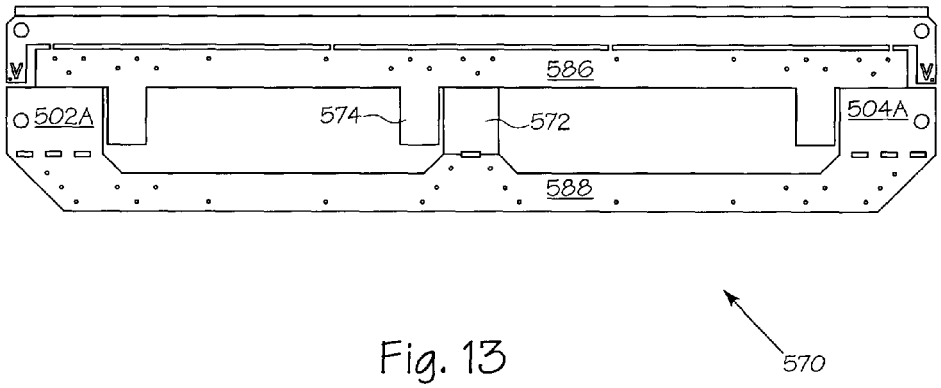
FIG. 13 is a top view of an alternate configuration of a foundation bolt placement template according to the present disclosure.

Referring now to FIGS. 9(*a*)-(*c*), foundation bolt placement template 500 is one aspect of the present invention. Foundation bolt placement template 500 includes bolt platforms 502 and 504, inside plate 506, outside plate 508 and securing tabs 510 and 512 and bolt spacing tab 506A. Bolt platforms 502 and 504 are generally horizontal and include holes 503 and 505 respectively. Bolt spacing tab 506A includes holes 503A and 505A. Holes 503 and 505 are provided to hang foundation bolts such as bolt 516 through bolt platforms 502 and 504, supported by foundation bolt nuts such as nut 518, during fabrication of foundation 514. Holes 503A and 505A are provided to locate foundation bolts such as bolt 516 during fabrication of foundation 514. Bolt spacing tab 506A is separated from foundation bolt placement template 500 at separation points X, Y, and Z. Flap 509 is folded about 90° along fold line C-C'. Bolt spacing tab 506A is secured to form 501 as shown in FIG. 12. A bolt hung through hole 503 and 503A, or 505 and 505A will be controlled during concrete pouring and remain vertical. Bolt platforms 502 and 504 are separated by concrete access 511 that allows wet concrete to be easily poured through foundation bolt placement template 500 during fabrication of foundation 514. Outside plate 508 foldably joins bolt platforms 502 and 504 along indented and perforated fold line A-A'.

Figure 19B:
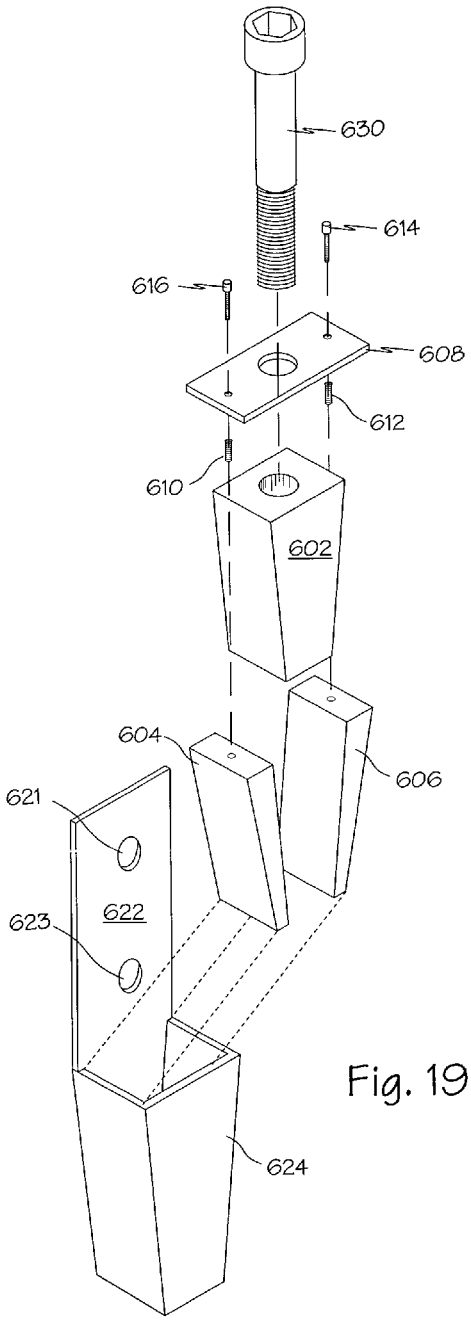
FIG. 19B is an exploded perspective view of the self-tightening holdown of FIG. 19A.
Figure 19A:
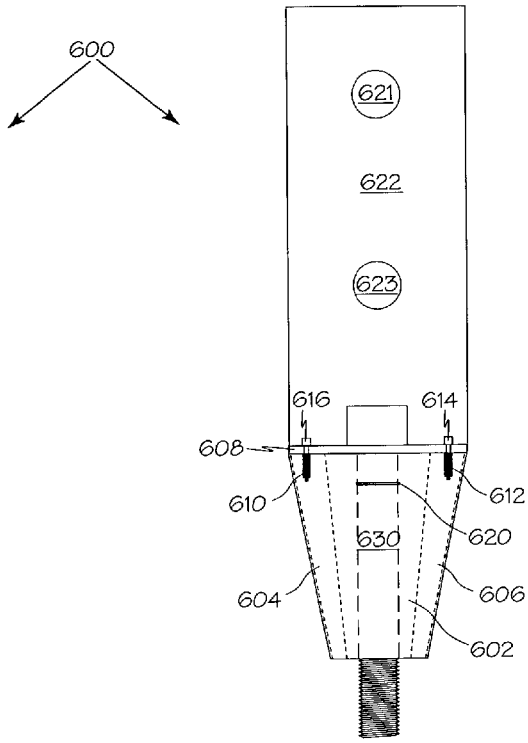
FIG. 19A is a front view of a self-tightening holdown according to the present disclosure.

A plurality of fastener points 520 on outside plate 508 allow foundation bolt placement template 500 to be temporarily fastened to outside form 501 (also shown in FIGS. 19(*a*)-(*b*) and 20(*a*)-(*b*) below) during fabrication of foundation 514. Temporary attachment of foundation bolt placement template 500 to outside form 501 allows accurate placement of foundation bolt placement template 500 which supports foundation bolts such as bolt 516. Securing tabs 510 and securing tab 512 are captured within the wet concrete of foundation 514 during fabrication of foundation 514 and provide lateral force resistance at the frame-foundation interface after foundation 514 has hardened. After foundation 514 has hardened, temporary fasteners securing foundation bolt placement template 500 to outside form 501 may be removed to allow outside form 501 to be removed. Outside plate 508 may be folded about 90° along indented and perforated fold line A-A'. A rigid structural panel such as rigid structural panel 2 or 530 may be secured between inside plate 506 and outside plate 508 using a plurality of fasteners (not shown) through fastener points such as fastener point 520. Inside plate 506 is perpendicular to bolt platforms 502 and 504 and joins bolt platforms 502 and 504 along inside edge B-B'.

Figure 11A:
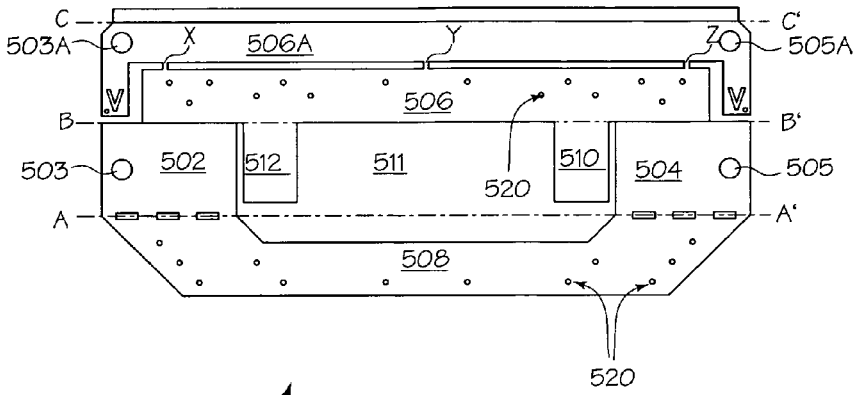
FIG. 11A is a top view of a currently preferred configuration of a foundation bolt placement template according to the present disclosure.
Figure 11C:
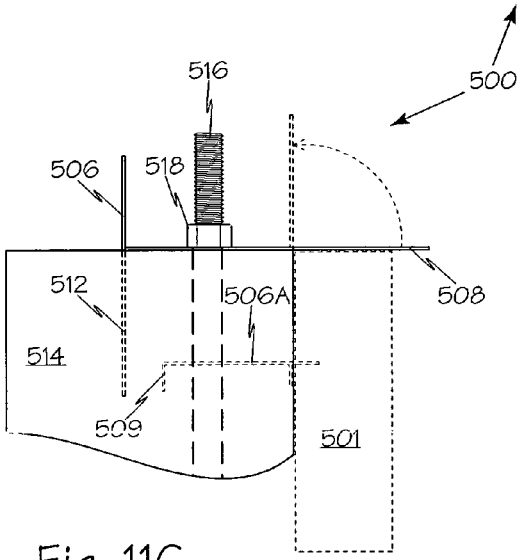
FIG. 11C is an end view of the foundation bolt placement template of FIG. 11A.
Figure 11B:
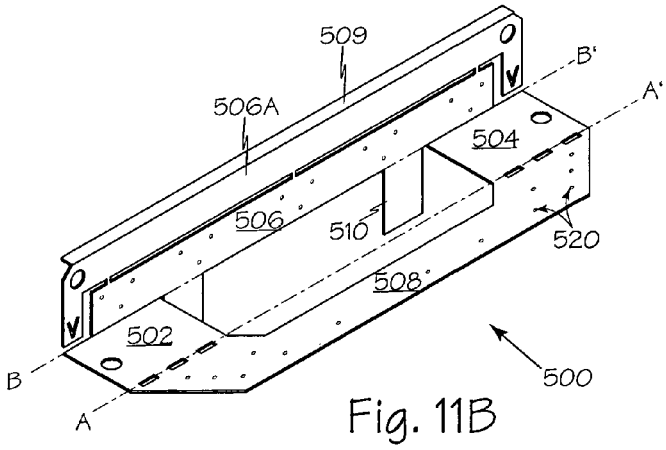
FIG. 11B is a perspective view of the foundation bolt placement template of FIG. 11A.

Referring now to FIGS. 11 and 12, foundation bolt placement templates 560 and 570 illustrate templates necessary to accommodate the wider lateral force resistance panels shown in FIGS. 7 and 8. As structural panels get wider a tie plate and adjacent securing tab are added for each vertical support in the panel. To accommodate rigid structural panel 300 tie plate 572 and securing tab 574 added. Tie plate 572 is added to connect inside plate 586 and outside plate 588 and to isolate vertical support 302 from the foundation. For the wider rigid structural panel 400, tie plates 572B and 576 and securing tabs 574B and 578 are added. The added securing tabs provide increased resistance to shear forces at the frame foundation interface.

Referring now to FIGS. 17(*a*)-(*b*), reinforcing plate 700 is fabricated to have a plurality of teeth such as tooth 705 to secure reinforcing plate 700 in place. Punches such as punch 701 are made in reinforcing plate 700 to create teeth such as tooth 705. Area 704 adjacent to holes 702 and 703 respectively is free of punches 701.

Figure 14:
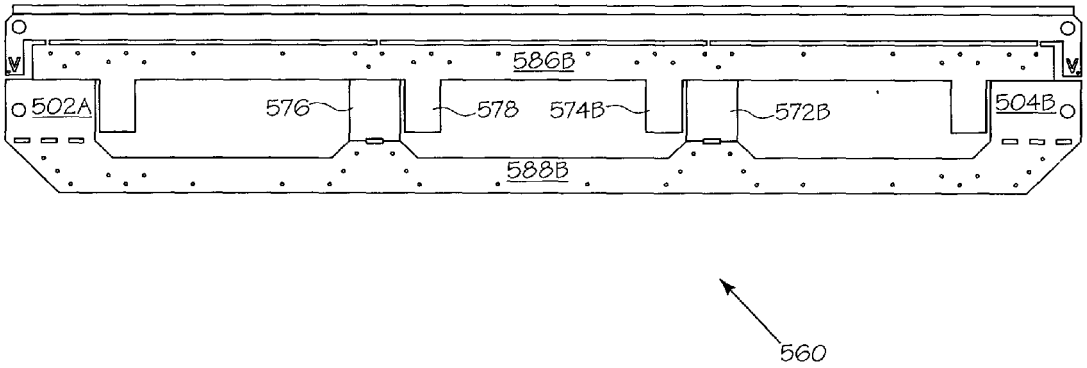
FIG. 14 is a top view of another alternate configuration of a foundation bolt placement template according to the present disclosure.
Figure 15:
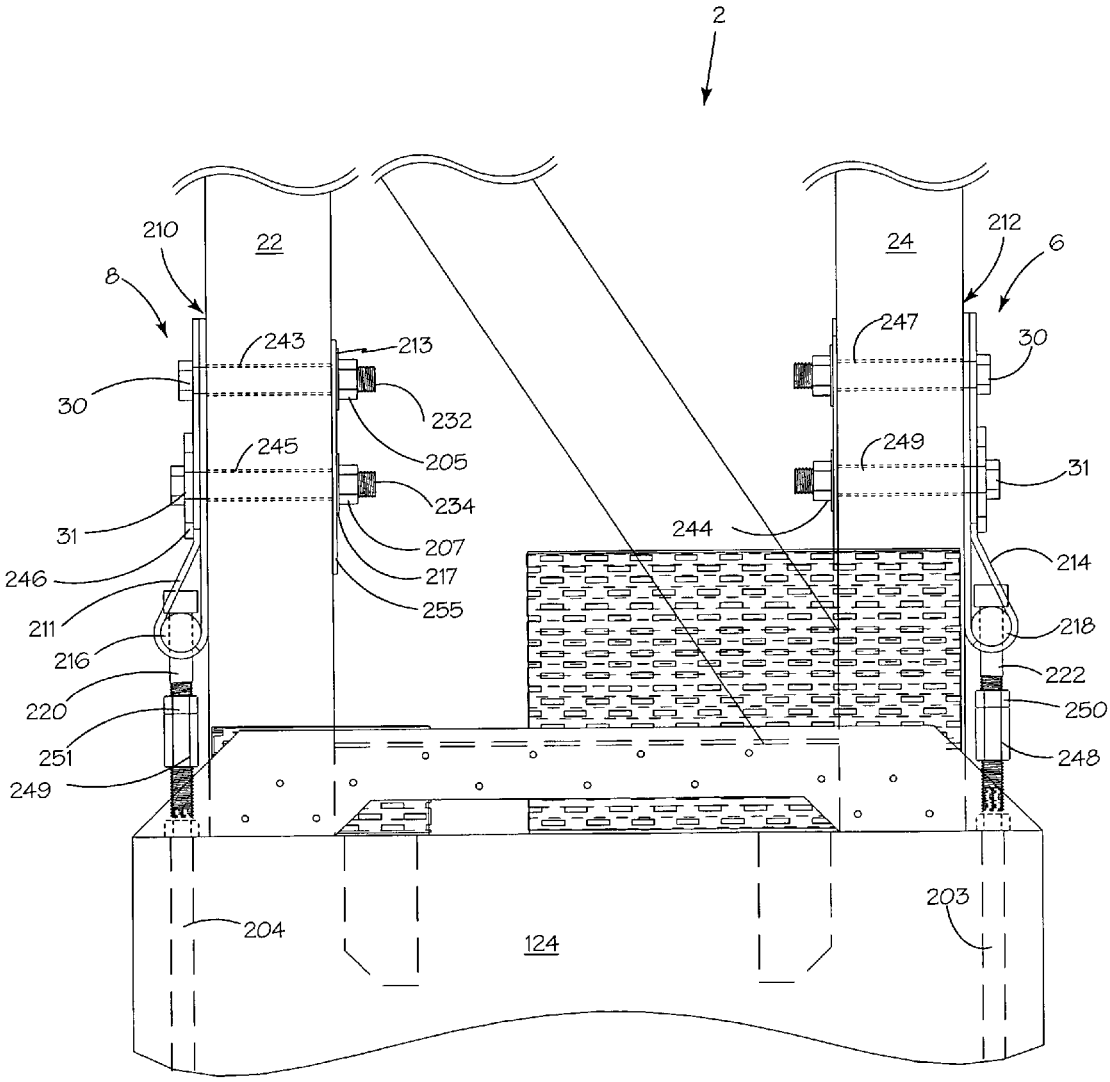
FIG. 15 is a detail view of the frame-foundation interface of FIG. 6.
Figure 16:
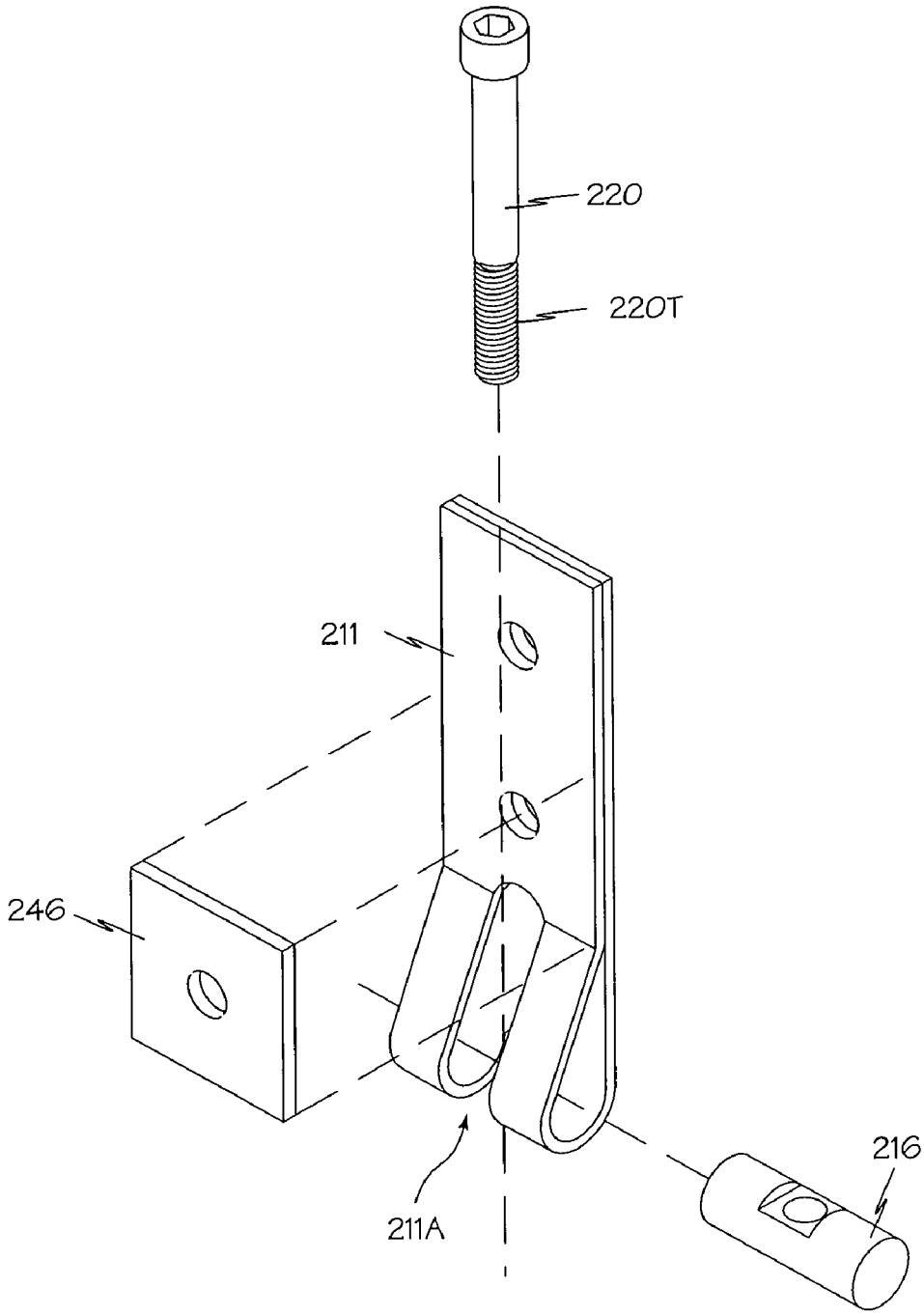
FIG. 16 is an exploded perspective view of the interconnection of some of the components of the holdown of FIG. 6.

Referring now to FIG. 15 Rigid structural panel 2 is further secured to foundation 124 using holdowns such as holdown 6 and 8. In the currently preferred embodiment of the present invention, holdown straps 211 and 214 are folded metal strap of 3/16" steel, although any other suitable material may be used. Pin 216 and 218 fit within folded holdown straps 212 and 214 respectively. Holdown straps 211 and 214 are slotted, as shown in FIGS. 14 and 16(*a*)-(*c*), to accommodate holdown screws such as screws 220 and 222. Screws 220 and 222 extend perpendicular to the longitudinal axis of pins 216 and 218 respectively. The use of pins 216 and 218 and slots 212A and 214A permit screws 220 and 222 to rotate within the plane of rigid-structural panel 2 and engage a holdown bolt that was not embedded perpendicular to the foundation. In a further aspect of the present invention, each holdown 6 and 8 is secured to rigid structural panel 2 using an upper bolt 30 and a lower bolt 31.

For first side member 22, upper bolt 31 penetrates holdown strap 212, first reinforcement plate 211, first side member 22, and sleeve 243. Threaded end 232 may be secured by nut 205 against a first plate washer 255. Lower holdown bolt 31 penetrates retaining plate 246, holdown strap 212, first reinforcement plate 211, side member 22, and sleeve 245. Threaded end 234 may be secured by nut 207 against plate washer 255. Threaded end 220T of holdown screw 220 secures rigid structural panel 200 to foundation bolts such as bolts 203 and 204 by means of coupling nuts 248 and 249 which simultaneously engage holdown screw 222 and 220 and foundation bolt 203 and 204.

In another aspect of the present invention sleeves such as sleeve 243, 245, 247 and 249 are pressed through holes 9 in first side member 22 and second side member 24. The sleeves improve the load bearing capacity of side member 22 at the point of holdown attachment. The sleeves may be made of any rigid material, steel has proven to be the most effective yet tested. Exterior side member surfaces such as surface 22A and surface 24A which are penetrated by holes 9 are reinforced by having a reinforcing plate such as plate 210 and 211 pressed into the exterior surface of the side member over the location of holes 9. Teeth, such as tooth 705 in FIG. 17(*b*) secure reinforcing plates 210 and 211 to side member 22 and 24 respectively. Each reinforcing plate bolt hole 702 and 703 is concentric with imbedded sleeves such as sleeves 243 and 245 after sleeves 243 and 245 are pressed into a side member such as first side member 22. Reinforcing plates 210 and 211 prevent splitting of first side member 22 and second side member 24 when a load is applied to holdowns 6 and 8. Reinforcing plates 210 and 211 also prevent elongation of holes 9 by resisting shear applied by holdown 6 and 8 at surfaces 22A and 24A respectively. Central area 704 surrounds bolt holes 702 and 703 and is solid to improve the shear resistance and minimize hole elongation of reinforcing plates 210 and 211.

In the currently preferred configuration of the present disclosure, holdown screws such as screw 220 are 5/8" steel capscrews having a tensile strength over 180,000 lbs. conforming to ASTM A574. Screw 220 is the principal means of transferring lateral loads to the foundation; therefore, the tensile strength may be selected for the maximum load expected.

Referring now to FIGS. 16(*a*)-(*c*), strap 710 is shown in detail. Folding strap 710 along F-F' forms a holdown such as holdown 6. Hole 732 is aligned with hole 740 and hole 734 is aligned with hole 738. Plate washer 712 is added for additional stability.

Referring now to FIGS. 17(*a*)-(*b*), self-tightening holdown 600 includes main wedge 602 and tightening wedges 604 and 606 within holdown pocket 624. Holster strap 622 is secured to a rigid structural panel or other structural element using holes 621 and 623. During installation, fasteners 614 and 616 secure plate 608 to tightening wedges 604 and 606 against the force of compression springs 610 and 612. After holdown 600 is installed, fasteners 614 and 616 are removed. Holdown screw 630 is attached to main wedge 602 by retaining clip 620. During cyclic lateral force loading, relative movement between holster strap 622 and holdown screw 630 that causes holdown screw 630 and main wedge 602 to lift out of holdown pocket 624 allows springs 610 and 614 to push tightening wedges 604 and 606 deeper into holdown pocket 624. This self-tightening action minimizes the cyclic loosening effect of cyclic loading on the lateral force resisting system.

Figure 20:
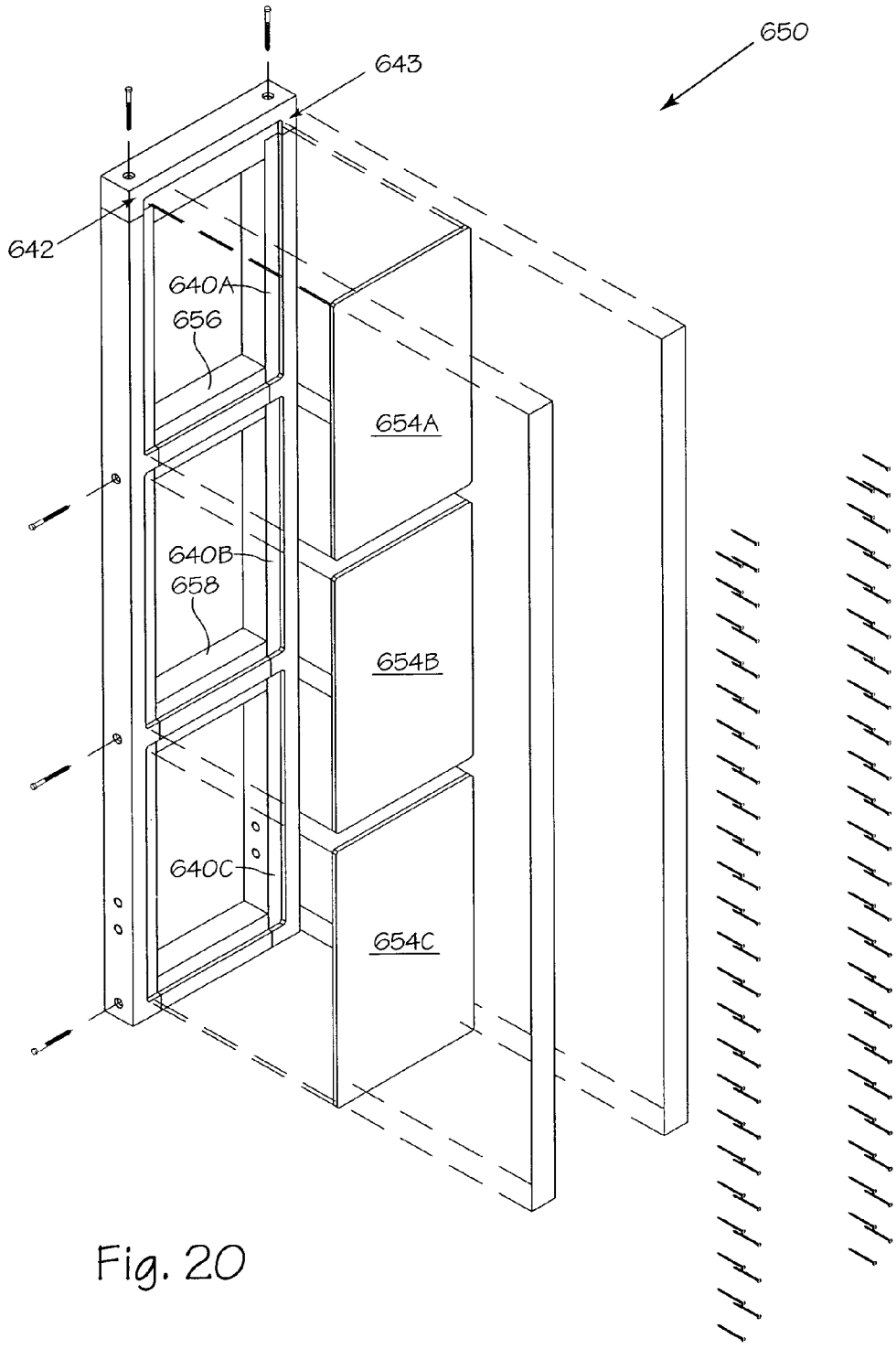
FIG. 20 is an exploded perspective view of another structural frame configuration according to the present disclosure.
Figure 21:
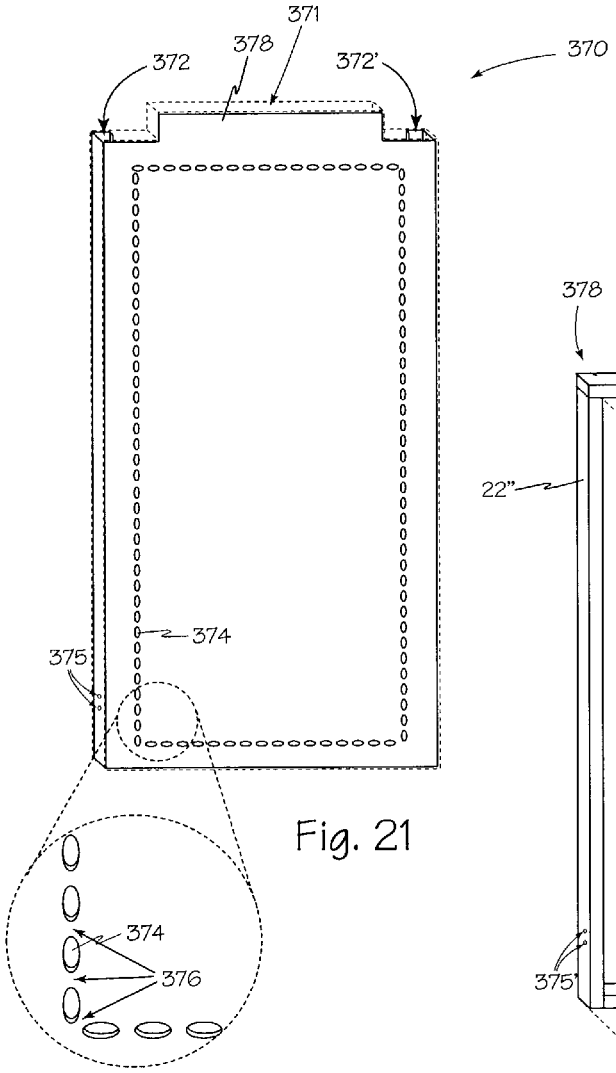
FIG. 21 is a perspective view of an alternate lateral force resisting panel according to one aspect of the present disclosure.
Figure 22:
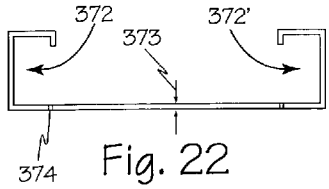
FIG. 22 is a top view of the lateral force resisting panel of FIG. 21.

Referring now to FIG. 20, multi-pane panel 650 includes a plurality of panes 654A, 654B, and 654C vertically oriented in rigid structural frame 652 and horizontal members 656 and 658. This configuration permits more flexibility of the finished rigid structural panel under cyclic loads and yields more open load hysteresis curves. By using multiple vertically oriented panes the rigidity of multi-pane panel 650 may be tailored to meet specific needs. Vertically oriented panes may also be used in wide rigid structural panels such as rigid structural panel 300, 400 and rigid structural panel 2'. In a currently preferred embodiment of the present invention a rigid structural panel having vertically oriented panes, panes 654A, 654B, and 654C are oriented strand board (OSB) panes and are inset into dado 640A, 640B, and 640C respectively. Plates may be fastened over vertical joints 642 and 643 formed between panes 654A, 654B, and 654C and rigid structural frame 652 as discussed above.

Figure 23:
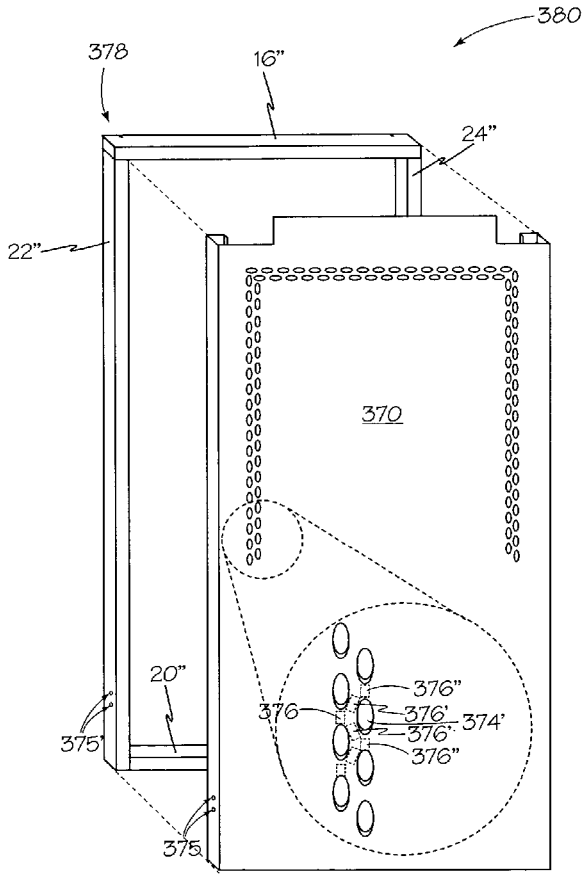
FIG. 23 is a perspective view of an alternate hybrid lateral force resisting panel.

Referring now to FIG. 23 in another configuration of a lateral force resisting system, structural panel 370 may be formed from a single piece of metal such as steel or other suitable material. At least three bends or folds may produce post channels 372 and 372'. Panel 370 may have a sufficiently large dimension 373 to function with or without a supporting structural frame. For various compositions of material used to form panel 370, other material characteristics such as density, brittleness, hardness, or other suitable characteristics may determine whether a panel may operate without a structural frame such as frame 378. To enable lateral force resisting panel 370 to flex when experiencing lateral loading, a plurality of ductility apertures 374 may be opened in panel 370. The ductility apertures focus applied energy to ductility elements 376. The number and geometry of ductility elements 376, as well as the thickness 373 and the material properties of the structural panel 370 may determine the ductility of the lateral force resisting system when lateral loading is applied to the lateral force resisting system.

Attachment areas such as flange 378 may also be incorporated into structural panel 370. Flange 378 may be used to secure structural panel 370 to the plate members or other suitable members of the wall or wall section that structural panel 370 is secured within. Holdown attachment points 375 permit attachment of a holdown to lateral resistance panel 370 outside perimeter 371 to enable lateral resistance panel 370 to develop maximum load with minimal overturning force.

Referring now to FIG. 23, hybrid structural panel 380 includes structural frame 378 and lateral force resisting panel 370. Side posts 22" and 24" are sized to fit within post channels 372 and 372' respectively. Compared with other configurations, the present hybrid panel may require posts having smaller diameter than other configurations. For example, posts 22" and 24" may be 2×4 with nominal cross section dimensions of 1.5" by 3.5" or other suitable dimensions.

As in prior configurations, the number of ductility elements 376 provided in a lateral force resisting panel such as panel 370 determines the yield strength of the lateral force resisting system to cyclic loading. In prior configurations the lateral resisting elements were nails, in the current configuration, the ductility elements 376 between pairs of ductility apertures serve to resist the lateral loads and enable a ductile response to cyclic loading. The number of ductile elements may be the same regardless of the vertical dimension of the panel for a given yield strength.

For example, a six-foot tall panel that is two feet wide with a yield strength of 4500 pounds may require a total of 100 ductile elements generally arranged as shown in FIG. 23. If the panel were increased in size to eight foot tall by four feet wide and yield strength of 4500 pounds, the larger panel would require the same 100 ductile elements.

Figure 25:
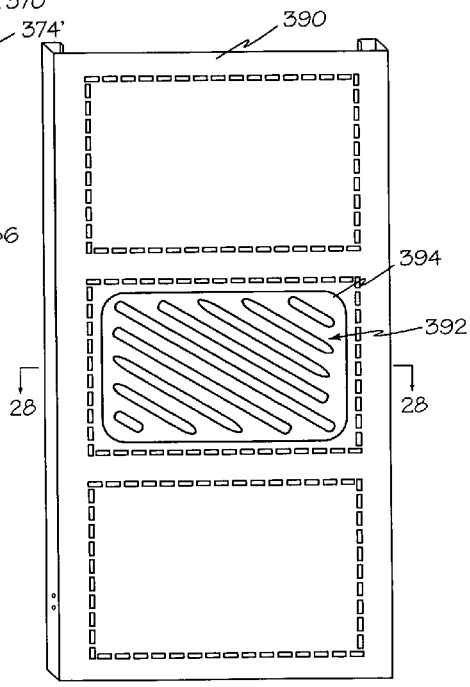
FIG. 25 is a perspective view of another alternate hybrid lateral force resisting panel showing alternate pane configurations.

Currently preferred results are obtained using ductile apertures with 2:1 aspect ratios and a generally smooth shape such as a rounded rectangle. Any other suitable configuration and shape may be used. Ductile element such as ductile elements 376 may be provided in geometries to direct the lateral loading or to minimize the effects of lateral loading on particular areas of the panel. For example, the equal distribution of ductile elements 376 in lateral resisting panel 370 provides an equivalent ductile response around the perimeter of the lateral resisting panel 370. In some circumstances a user may wish to provide all the ductile elements at or near the top of the panel as illustrated in FIG. 25. In this configuration, each ductility aperture such as ductility aperture 374' may have four ductility elements, two primary ductility elements 376", and two secondary ductility elements 376'.

Figure 24:
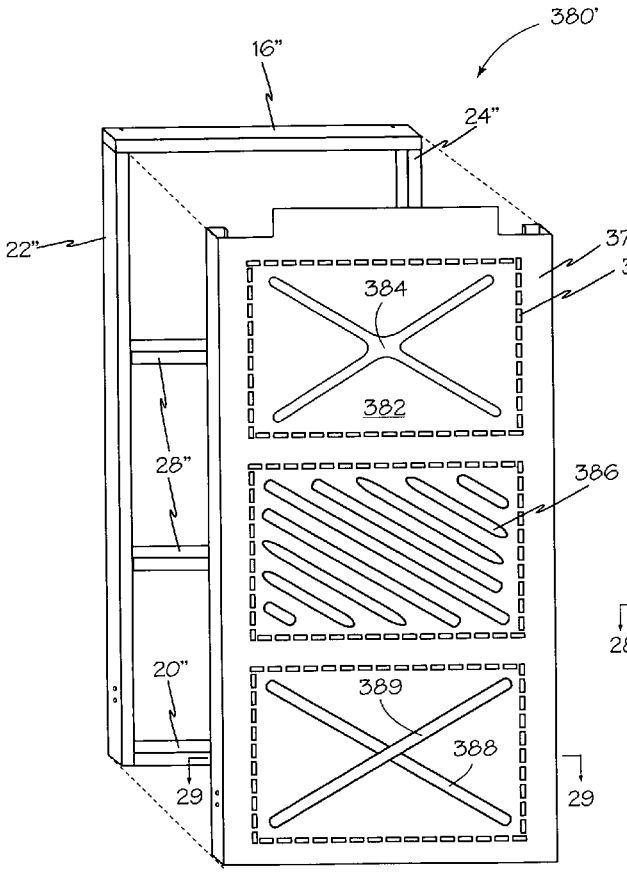
FIG. 24 is a perspective view of another alternate hybrid lateral force resisting panel showing alternate pane configurations.
Figure 28:
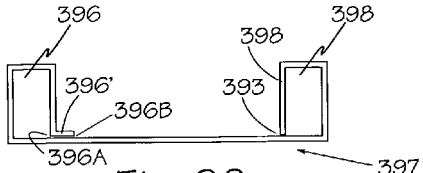
FIG. 28 is a top view of alternate configurations for a lateral force resisting panel.

Referring now to FIG. 24, an alternate configuration of a hybrid lateral force resisting panel may incorporate one or more lateral resistance panes or subpanels, such as pane 382, subdivided from lateral force resisting panel 370' by a plurality of ductility apertures 374'. Lateral force resistance panel 370' may include one or more stiffening elements such as stiffener 384, a plurality of stiffener elements such as stiffener element 386, or a combination of cooperative stiffener elements such as stiffener elements 388 and 389. Stiffener elements may be added to any appropriate side of a lateral force resisting panel and they may be welded or otherwise attached as shown in FIG. 26, or they may be stamped in as shown in FIGS. 27 and 28.

Figure 27:
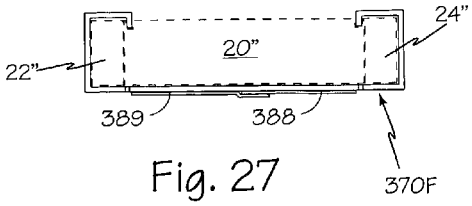
FIG. 27 is a cutaway view of the lateral force resisting panel of FIG. 24 taken along line 29-29.

Referring now to FIG. 27 stiffener elements 388 and 389 may be added to front surface 370F. Alternatively stiffener elements such as elements 388 may be added to the rear surface of panel 370'.

Figure 26:
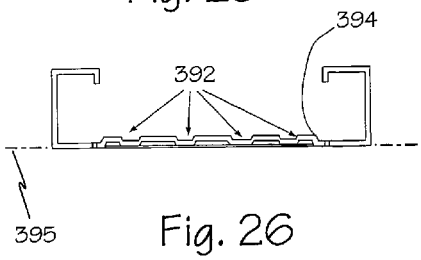
FIG. 26 is a cutaway view of the lateral force resisting panel of FIG. 25 taken along line 28-28.

Referring now to FIG. 25 and FIG. 26, stiffener element array 392, and stiffener rim 394 may be stamped into lateral force resisting panel 390. The combination of stiffener array 392 and stiffener rim 392 may prevent deflection of lateral force resisting panel Referring now to FIG. 28, a lateral resisting panel according to the present disclosure may include alternate configurations for post channels 396 and 398. Any other suitable configuration may be used. In post channel 396, lip or flange 396' may be secured, or otherwise attached to panel lateral force resisting panel 397 along 396A or 396B to provide one or more performance benefits. Similarly flange 398' may also be secured to panel 397 along edge 393.

Figure 29:
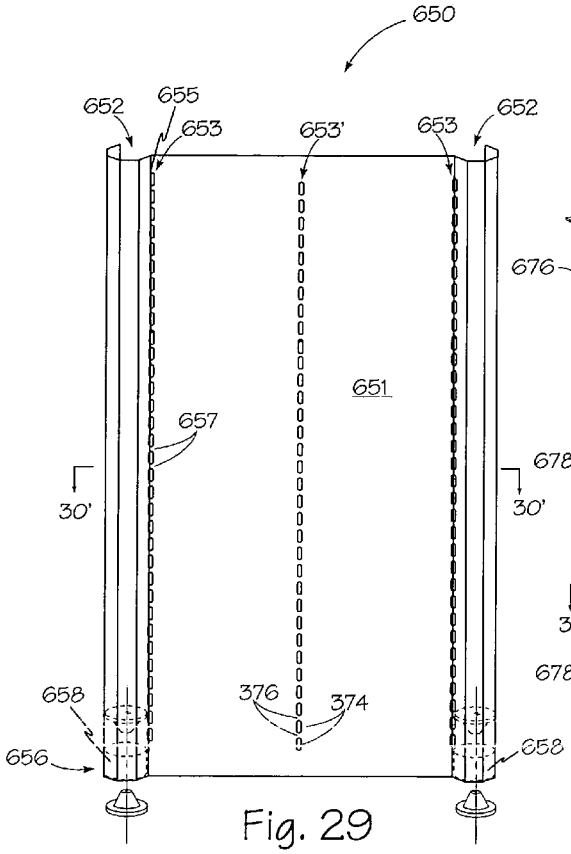
FIG. 29 is a perspective view of a unitary lateral force resisting panel.
Figure 30:
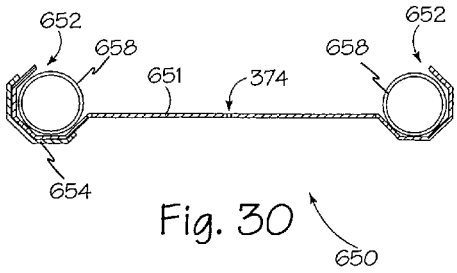
FIG. 30 is a cutaway view of the lateral force resisting panel of FIG. 29 taken along line 30'-30'.

Referring now to FIG. 29 and FIG. 30, lateral force resisting panel 650 may be formed from a single sheet of metal or other suitable material. A lightweight application may use 14 Ga. steel, a heavier application may use thicker or stronger material such as 10 or 12 Ga. steel or other suitable material or alloy. At least two post elements 652 may be formed by any suitable technique such as folding and may adopt any suitable shape. Here, an octagonal shape is used with three sides removed. One or more lateral force resisting panes such as pane 651 are located between each pair of post elements, and are formed by the creation of two or more post elements such as post elements 652. For some applications, post elements 652 may be externally reinforced by reinforcing elements such as reinforcing element 654 welded or otherwise secured to post element 652.

One or more arrays of ductility apertures such as array 653 or array 653' may be formed in lateral force resisting pane 651. Ductility aperture arrays may be formed in areas having a crease or fold such as fold 655. Ductility elements thus formed such as ductility elements 657 incorporate fold 655.

Base 656 may incorporate one or more base sleeves such as sleeves 658 welded or otherwise secured within post elements 652. Each base sleeve such as base sleeve 658 may use two or more suitable washers such as base washers 659 to engage base sleeve and using a suitable nut, secure base sleeve to a foundation bolt.

Figure 31:
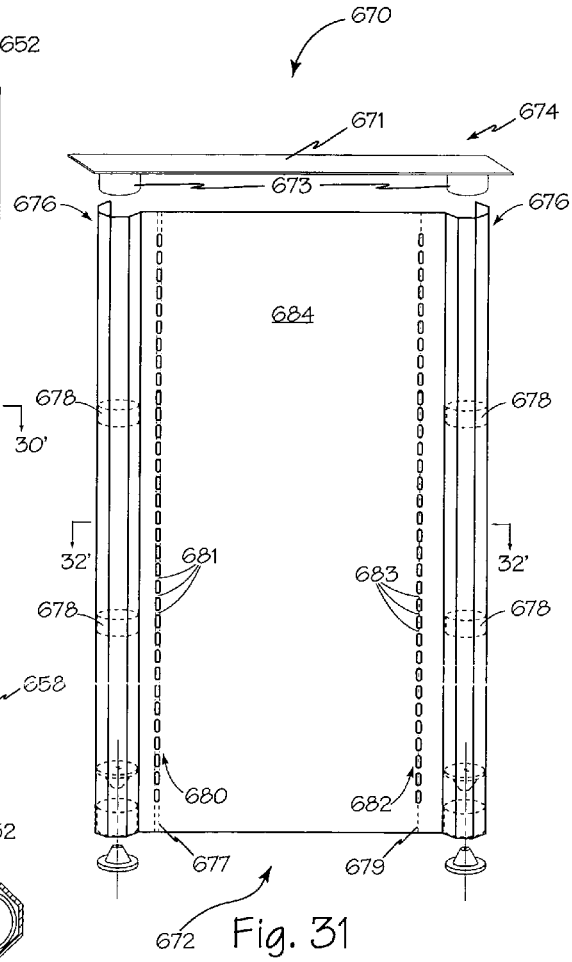
FIG. 31 is a perspective view of an alternate unitary lateral force resisting panel.
Figure 32:
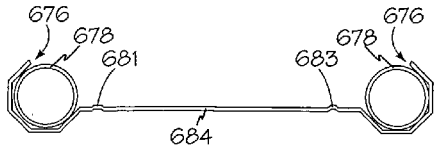
FIG. 32 is a cutaway view of the lateral force resisting panel of FIG. 31 taken along line 32'-32'.

Referring now to FIG. 31 and FIG. 32, in an alternate configuration, lateral force resistance system 670 includes upper attachment element 674 secured to lateral force resistance panel 672 to permit attachment to convention wall top plates or other building elements. Upper attachment element may 674 adopt any suitable configuration, in the present configuration, a generally flat plate 671 is welded or otherwise attached to support sleeves such as sleeves 673 and sleeves 673 are welded or otherwise secured to lateral resistance panel 672. Post elements 676 may include one or more stability sleeves such as stability sleeves 678 welded or otherwise secured within post element 676.

Lateral resistance pane 684 may include one or more arrays of ductility apertures such as array 680 or array 682. Lateral resistance pane 684 may be bent, folded, creased or otherwise molded in the area of ductility aperture arrays, such as folds 677 or bend 679, to impart an out of plane shape to ductile elements such as ductile elements 681 or 683.

Those skilled in the art will appreciate that the various adaptations and modifications of the just described configurations may be developed without departing from the scope and spirit of the invention. Therefore, it is to be understood that, within the scope of the appended claims, the invention may be practiced other than as specifically described herein.

We claim:

1. An apparatus comprising:

a lateral force resisting panel having an outside edge and a plurality of holdown attachment points on the outside edge of the panel;

a plurality of ductility apertures in the lateral force resisting panel, the ductility apertures forming a plurality of ductility elements, the plurality of ductility elements forming a plurality of control arrays, the plurality of control arrays defining at least one pane in the lateral force resisting panel;

a plurality of foundation bolts for embedding in a foundation or slab or stem wall; and a foundation bolt placement template for defining a mounting location for the lateral force resisting panel, and locating and supporting the foundation bolts during fabrication of the foundation or slab or stem wall; and means for attaching the lateral force resisting panel holdown attachment points to the foundation bolts for transferring the lateral forces applied to the lateral force resisting panel to the foundation or slab or stem wall.

2. The apparatus of claim 1 wherein the means for securing the structural panel to the foundation bolts further comprises:

a plurality of holdowns for transferring the shear forces developed in the structural frame to the foundation bolts, each holdown attached to at least one holdown attachment point, each holdown securing the lateral force resisting panel to a foundation bolt.

3. The apparatus of claim 1 further comprising:

a rigid, generally rectangular structural frame engaging the lateral force resisting panel, the structural frame having two coplanar vertical side members connected by two or more coplanar horizontal members forming a generally rectangular opening therebetween, each vertical side member having an inside surface and an outside surface; and a plurality of holdown attachment points on each vertical side member.

4. The apparatus of claim 3 wherein the rigid structural panel is attached to the vertical members using a plurality of fasteners securing the panel to each vertical member.

5. The apparatus of claim 1 wherein the lateral force resisting panel is a single piece of metal bent to form at least two post channels.

6. The apparatus of claim 1 wherein the plurality of control arrays subdivides the lateral force resisting panel into two or more subpanels.

7. The apparatus of claim 6 further comprising one or more stiffening elements within each subpanel.

8. The apparatus of claim 7 wherein the stiffening elements are formed in the lateral force resisting panel.

* * * * *